US012745891B2

(12) United States Patent
Kim et al.

(10) Patent No.: US 12,745,891 B2
(45) Date of Patent: Sep. 29, 2026

(54) DISHWASHER

(71) Applicant: LG Electronics Inc., Seoul (KR)

(72) Inventors: Sung Sik Kim, Seoul (KR); Doo Hyun Kim, Seoul (KR); Jeong In Kim, Seoul (KR); In Woo Baek, Seoul (KR)

(73) Assignee: LG Electronics Inc., Seoul (KR)

( * ) Notice: Subject to any disclaimer, the term of this patent is extended or adjusted under 35 U.S.C. 154(b) by 420 days.

(21) Appl. No.: 17/989,580

(22) Filed: Nov. 17, 2022

(65) Prior Publication Data

US 2023/0148830 A1 May 18, 2023

(30) Foreign Application Priority Data

Nov. 18, 2021 (KR) ..... 10-2021-0159660
Nov. 18, 2021 (KR) ..... 10-2021-0159663

(51) Int. Cl.
*A47L 15/48* (2006.01)
*A47L 15/22* (2006.01)
*A47L 15/50* (2006.01)

(52) U.S. Cl.
CPC ..... *A47L 15/486* (2013.01); *A47L 15/22* (2013.01); *A47L 15/50* (2013.01)

(58) Field of Classification Search
CPC ..... A47L 15/48; A47L 15/486
See application file for complete search history.

(56) References Cited

U.S. PATENT DOCUMENTS 3,126,024 A * 3/1964 Jellies ..... A47L 15/4225 134/107
2011/0139196 A1* 6/2011 Bartos ..... A47L 15/481 134/115 R
2017/0311771 A1* 11/2017 Lutz ..... A47L 15/481

FOREIGN PATENT DOCUMENTS

| | | |
|---|---|---|
| DE | 102014215933 | 3/2016 |
| DE | 102014215933 A1 | 3/2016 |
| DE | 102015212863 A1 | 1/2017 |
| DE | 102015212869 | 1/2017 |
| EP | 2241242 A2 | 10/2010 |
| EP | 3987999 A1 | 4/2022 |

OTHER PUBLICATIONS

Machine Translation of Lutz et al., DE 102015212863 A1, Jan. 2017. (Year: 2017).*
Machine Translation of Busing et al., DE 102014215933 A1, Mar. 2016. (Year: 2016).*
Extended Search Report in European Appln. No. 22207739.8, mailed on Mar. 30, 2023, 10 pages.

* cited by examiner

*Primary Examiner* — David G Cormier
(74) *Attorney, Agent, or Firm* — Fish & Richardson P.C.

(57) ABSTRACT

The present disclosure relates to a dishwasher in which dry air spraying from an airflow guide is evenly distributed into a tub not to concentrate heat energy of the dry air on a specific portion, thereby reducing a dry period for wash targets and improving drying efficiency, and effectively preventing deterioration in drying efficiency, which is caused by a change in the direction of a discharge opening when misassembly occurs.

19 Claims, 24 Drawing Sheets

DISHWASHER

CROSS-REFERENCE TO RELATED APPLICATION

This application claims priority to and the benefit of Korean Patent Application No. 10-2021-0159660, filed on Nov. 18, 2021, and 10-2021-0159663, filed on Nov. 18, 2021, the disclosures of which are incorporated herein by reference in their entirety.

TECHNICAL FIELD

The present application relates to a dishwasher in which dry air spraying from an airflow guide is evenly distributed into a tub not to concentrate heat energy of the dry air on a specific portion, thereby reducing a dry period for wash targets and improving drying efficiency, and effectively preventing deterioration in drying efficiency, which is caused by a change in the direction of a discharge opening when misassembly occurs.

BACKGROUND

Dishwashers spray wash water such as water to a wash target such as cooking vessels, cooking tools and the like accommodated in them to wash the wash target. At this time, wash water used for washing a wash target can include detergent.

Ordinarily, dishwashers are comprised of a wash tub forming a wash space, a storage part accommodating wash targets in the wash tub, a spray arm spraying wash water to the storage part, and a sump storing water and supplying wash water to the spray arm.

Dishwashers help to reduce time and efforts taken to clean wash targets such as cooking vessels and the like after meals, thereby ensuring improvement in user convenience.

Ordinarily, dishwashers perform a washing process of washing wash targets, a rinsing process of rinsing the wash targets, and a drying process of drying the wash targets after the washing and rinsing processes.

In recent years, the drying stage of dishwashers involves supplying high-temperature dry air into the wash tub to reduce a drying period and promote the effect of sterilizing wash targets.

As a related art, a dishwasher provided with a hot air supply device that generates and supplies high-temperature dry air after the washing and rinsing stages is disclosed in DE Patent Publication No. 102015212869 (document 001).

In the dishwasher according to document 001, a dry air spray part for spraying dry air generated through a hot air supply device, disposed under a tub, into the tub is disposed in the tub.

At this time, the dry air spray part is provided with a plurality of spray openings from which dry air sprays in different directions.

However, in the configuration according to document 001, the plurality of spray openings is configured to face the central portion of the tub directly.

Accordingly, heat energy of dry air spraying through the spray openings concentrates on a lower rack and wash targets stored on the lower rack, that are closest to the plurality of spray openings, and the heat energy cannot be transferred sufficiently to wash targets stored on an upper rack and a top rack that are disposed at the upper side of the lower rack.

Additionally, since dry airflow spraying through the plurality of spray openings has directionality facing the lower surface of the lower rack closest to the plurality of spray openings, high flow resistance is applied to the dry airflow due to the wash targets stored on the lower rack. Thus, the dry airflow cannot be distributed evenly to the upper rack and the top rack, causing a significant decrease in drying efficiency for the wash targets stored on the upper rack and the top rack.

Further, the plurality of spray openings according to document 001 is disposed to face a door. Accordingly, it is highly likely that most of the hot air having passed through the plurality of spray openings passes through the open door and is discharged out of the dishwasher without passing through wash targets. The drying efficiency for wash targets of the dishwasher according to document 001 can significantly deteriorate.

Further, the dry air spray part according to document 001 is configured to be fastened to a hot air supply pipe that passes through the tub and extends.

At this time, the dry air spray part can be fastened to the hot air supply pipe simply based on a press-fitting manipulation, thereby ensuring the simplification of an assembly process or a fastening process.

However, to set the right position of the dry air spray part and prevent the misassembly of the dry air spray part, the dry air spray part is designed to have an outer shape corresponding to the shape of the edge of the tub. That is, the shape of the edge of the tub and the outer shape of the dry air spray part corresponding to the shape of the edge of the tub helps to prevent a coupling outside the predetermined right position.

Since the dry air spray part according to document 001 has an outer shape corresponding to the shape of the edge of the tub as described above, the dry air spray part has a large size.

The large-sized dry air spray part disposed in the wash space of the tub causes a substantial reduction in an available wash space of the tub, and interference with other components including a lower spray arm and the lower rack disposed in the tub.

PRIOR ART DOCUMENT

Patent Document (Document 001) DE Patent Publication No. 102015212869

SUMMARY

Technical Problems

The first objective of the present disclosure is to provide a dishwasher in which dry air spraying from an airflow guide is distributed evenly into a tub, not to concentrate heat energy of the dry air on a specific portion, thereby reducing a dry period for wash targets.

The second objective of the present disclosure is to provide a dishwasher in which a discharge opening spraying dry air does not face a lower rack directly, is disposed in a lower most position in the up-down direction, does not face a door directly, such that dry airflow is distributed evenly into the tub and dry air remains in the tub for a sufficient period of time, thereby ensuring significant improvement in drying efficiency.

The third objective of the present disclosure is to provide a dishwasher in which a smaller airflow guide is provided than that of the related art, to prevent a substantial reduction in the available wash space of the tub and interference with other components in the tub, and to ensure an enough distance between the airflow guide and the inner surface of the tub, thereby reducing the possibility of fixation of food and the like.

The fourth objective of the present disclosure is to provide a dishwasher which has a symmetrical shape regardless of the shape of the edge of the tub to make the dishwasher smaller, to which an airflow guide formed in a way that at least two segment bodies are coupled is applied to achieve a somewhat complex inner flow direction diverting structure, in which the misassembly between the segment bodies, caused by the symmetrical outer shape, is effectively prevented, and in which when misassembly occurs, a reduction in the drying efficiency that can occur as the direction of a discharge opening changes is effectively prevented.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

A dishwasher according to the present disclosure comprises a tub accommodating a wash target and having a wash space a front surface of which is open: a dry air supply part being disposed at a lower portion side of the tub, generating dry air for drying the wash target and supplying the dry air into the wash space; a lower rack being accommodated in the wash space in a way that is withdrawn from the wash space through the front surface and allowing the wash target to be mounted on; and an airflow guide being disposed between the lower rack and a lower surface of the tub and converting a flow direction of the dry air to spray the dry air into the wash space, wherein the airflow guide is disposed closer to a rear surface of the tub than the lower rack. Accordingly, drying efficiency for wash targets may improve and a drying period may decrease.

The dishwasher may further comprise a door opening and closing the front surface of the tub, and in the state where the upper portion of the front surface of the tub is at least partially open by the door, the dry air may be supplied into the wash space.

The lower rack in a state of being accommodated in the wash space may be spaced a first distance apart from the rear surface of the tub, and the airflow guide may be spaced a second distance apart from the rear surface of the tub, and the second distance may be less than the first distance.

Additionally, a space having the first distance may be formed between the lower rack and the rear surface of the tub in a state of being accommodated in the wash space, a rear end portion of the airflow guide may be spaced the second distance apart from the rear surface of the tub and disposed in the space, and a front end portion of the airflow guide may be disposed at a lower side of the lower rack.

The airflow guide may be provided with a discharge opening that sprays dry air the flow direction of which changes to the wash space, at least a portion of the dry air spraying from the discharge opening may spray toward between the lower surface of the tub and the lower rack, and the remaining portion of the dry air spraying from the discharge opening may spray toward the space.

The discharge opening may be formed into a slit that extends along the front-rear direction, between the front end portion and the rear end portion of the airflow guide.

Further, a front edge of the discharge opening may be disposed at the lower side of the lower rack, and a rear edge of the discharge opening may be disposed in the space.

Further, a surface area of a portion of the discharge opening, escaping from the lower rack and being disposed in the space, may account for 25% to 50% of an entire surface area of the discharge opening.

The discharge opening may have an up-down height less than a front-rear length.

The up-down height of the discharge opening may remain constant in the front-rear direction.

The dishwasher may further comprise a lower spray arm being rotatably disposed between the lower surface of the tub and the lower rack and spraying wash water for washing the wash target, and the airflow guide may be disposed outside a rotation range of the lower spray arm.

The airflow guide may be disposed between an edge being formed by the rear surface, the lower surface and a left side surface of the tub, which are met, and the rotation range of the lower spray arm.

The airflow guide may be separated and spaced from the lower surface and the left side surface of the tub respectively.

Further, a front edge of the discharge opening may be formed on a right side surface of the airflow guide facing a right side surface of the tub, and a rear edge of the discharge opening may be formed on a rear surface of the airflow guide facing the rear surface of the tub.

The airflow guide may comprise a lower guide being coupled to the dry air supply part and allowing dry air generated in the dry air supply part to come in; and an upper guide having a lower surface that is open, being fastened to an upper side of the lower guide, and forming a discharge opening spraying the dry air together with the lower guide, wherein the airflow guide may be provided with a misassembly prevention part that prevents the upper guide from escaping from a predetermined right position and being coupled to the lower guide.

The misassembly prevention part may prevent the upper guide from being fastened to the lower guide in a position outside the predetermined right position.

The lower guide may be provided with a reference surface which forms a lower end edge of the discharge opening, and comprise a guide main body which has a plate shape and to which the open lower surface of the upper guide is coupled, the misassembly prevention part may comprise a misassembly prevention groove that extends along an outer edge of the guide main body, and with respect to an up-down direction, is depressed lower than the reference surface, and as the upper guide is arranged in the predetermined right position, a lower end portion of the upper guide can be inserted into the misassembly prevention groove.

Further, as the upper guide is arranged outside the predetermined right position, the lower end portion of the upper guide cannot be inserted into the misassembly prevention groove.

The reference surface may extend to one side edge of the guide main body, and the misassembly prevention groove may extend along an outer edge of the guide main body except for an area in which the reference surface is formed.

The upper guide may be provided with a notch hole forming a front edge, a rear edge and an upper end edge of the discharge opening, and a lower end of the notch hole may extend to a lower end portion of the upper guide and be open entirely.

Further, as the upper guide is coupled to the lower guide in a state in which the upper guide is arranged in the predetermined right position, the reference surface of the lower guide may be inserted into the open lower end of the notch hole.

Further, as the upper guide is coupled to the lower guide in a state in which the upper guide is arranged outside the predetermined right position, the lower end portion of the upper guide can be held by the reference surface of the lower guide and cannot be inserted into the misassembly prevention groove.

The lower guide may further comprise a duct coupling part which has a cylindrical shape and is integrally formed at the guide main body, and a lower end of which connects to the dry air supply part, and the misassembly prevention part may comprise an upper guide holding projection protruding from an outer side surface of the duct coupling part; and an upper guide holding hole being disposed in a position corresponding to the upper guide holding projection, and being formed in a way that penetrates an inside and an outside of the upper guide.

Further, as the upper guide is coupled to the lower guide in a state in which the upper guide is arranged in the predetermined right position, the upper guide holding projection may be inserted into the holding hole, and the upper guide may be fastened to the lower guide.

Further, as the upper guide is coupled to the lower guide in a state in which the upper guide is arranged outside the predetermined right position, the upper guide holding projection cannot be inserted into the holding hole.

Further, an outer shape of the guide main body of the lower guide may be symmetrical with respect to the front-rear direction, when viewed from above.

Further, an outer shape of the upper guide may be symmetrical with respect to the front-rear direction, when viewed from above.

The airflow guide may further comprise a cap cover being disposed at an upper side of the upper guide, being coupled to the upper guide and having an outer shape that is symmetrical with respect to the front-rear direction, when viewed from above, and the misassembly prevention part may comprise a cap cover holding projection protruding from an outer side surface of the upper guide; and a cap cover holding hole being provided in a position corresponding to the cap cover holding projection, and penetrating an inside and an outside of the cap cover.

Advantageous Effects

A dishwasher according to the present disclosure has the effects of distributing dry air evenly and ensuring a period for which dry air remains in a tub sufficiently, thereby improving drying efficiency and decrease a drying period.

The dishwasher according to the present disclosure has the effect of preventing wash water from coming in reversely through a discharge opening that is exposed directly to a wash space.

The dishwasher according to the present disclosure has the effect of preventing wash water flowing into an airflow guide from coming into a dry air supply part.

The dishwasher according to the present disclosure has the effect of simplifying an assembly structure and a fixation structure of the airflow guide spraying dry air, thereby ensuring the simplification of assembly and fixation processes of the dry air supply part.

The dishwasher according to the present disclosure has the effect of preventing a change in a predetermined position of the discharge opening through a means of preventing misassembly between an upper guide and a lower guide that constitute the airflow guide.

The dishwasher according to the present disclosure has the effect of preventing the airflow guide from being released or escaping from a predetermined position after the airflow guide is assembled and fixed to the dry air supply part, through a simple structure.

Specific effects are described along with the above-described effects in the section of detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
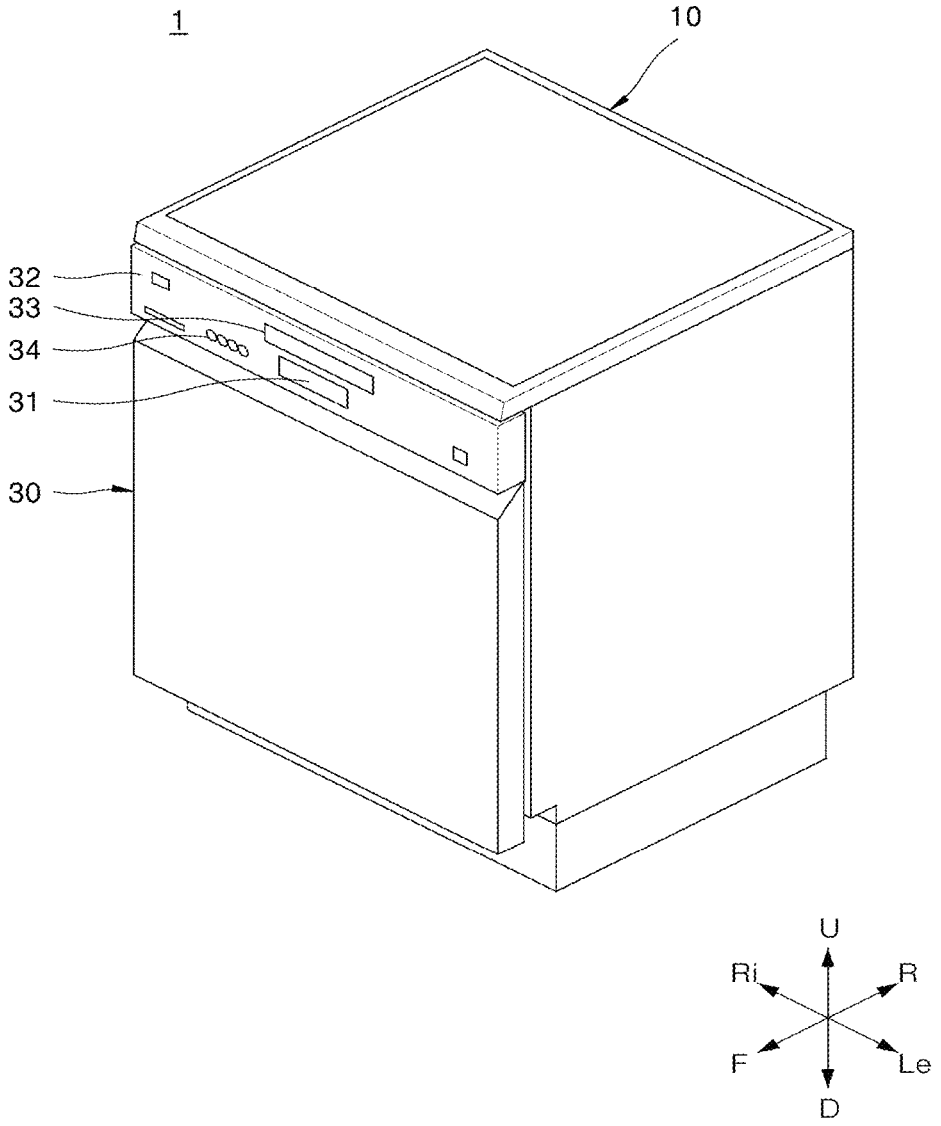
FIG. 1 is front perspective view showing a dishwasher of one embodiment.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Below, example embodiments according to the disclosure are specifically described with reference to accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

Throughout the disclosure, each component can be provided as a single one or a plurality of ones, unless explicitly stated to the contrary.

When one component is described as being "in the upper portion (or lower portion)" or "on (or under)" another component, one component can be directly on (or under) another component, and an additional component can be interposed between the two components.

When any one component is described as being "connected". "coupled", or "connected" to another component, any one component can be directly connected or coupled to another component, but an additional component can be "interposed" between the two components or the two components can be "connected". "coupled", or "connected" by an additional component.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A. B or A and B, and the terms "C to D" can denote C or greater and D or less, unless stated to the contrary.

Hereafter, the subject matter of the present disclosure is described with reference to the drawings showing the configuration of the dishwasher 1 of the embodiment

[Entire Structure of Dishwasher]

Figure 2:
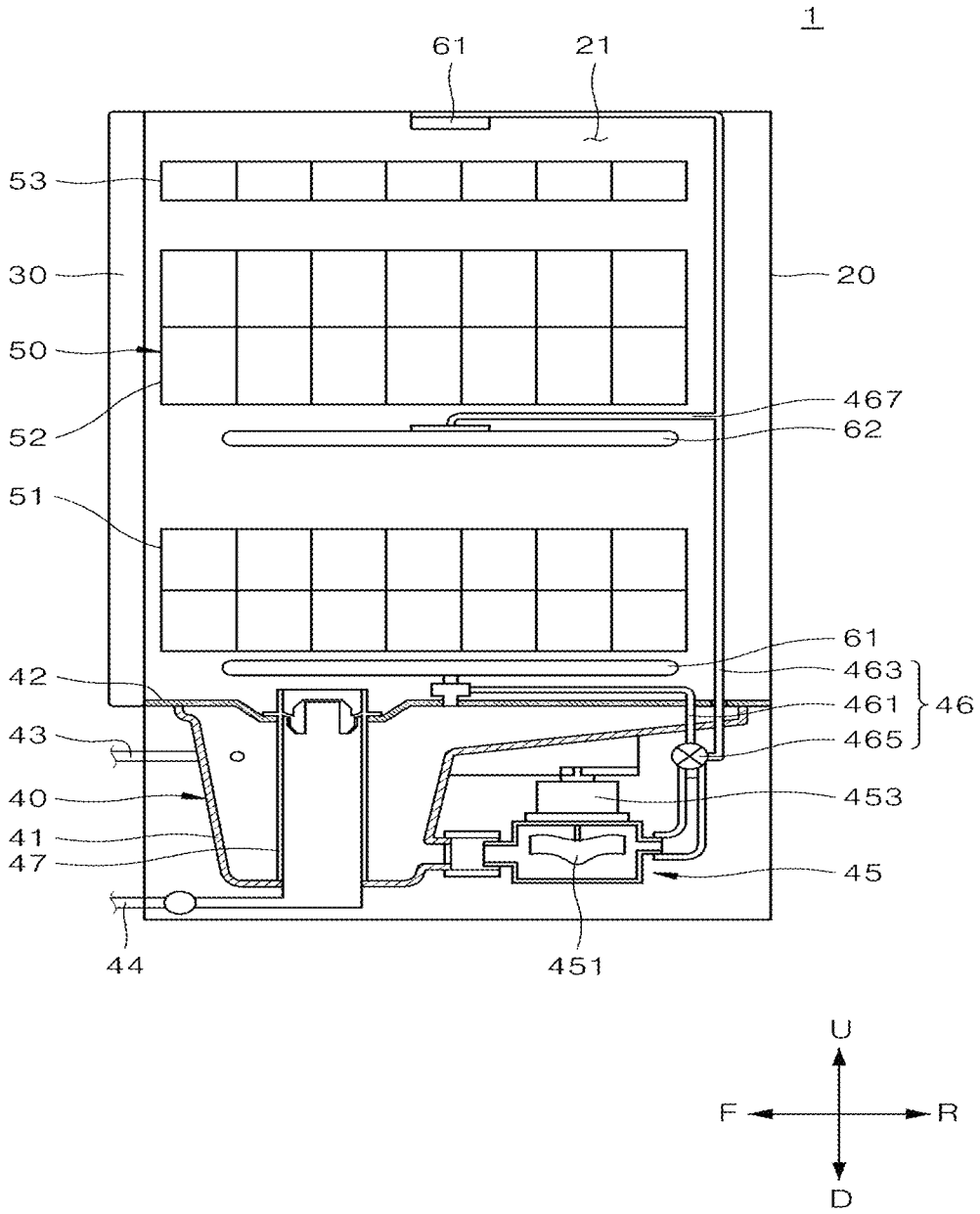
FIG. 2 is a schematic cross-sectional view showing the dishwasher in FIG. 1.

Hereafter, the entire structure of the dishwasher of one embodiment is described with reference to the accompanying drawings FIG. 1 is a front perspective view showing a dishwasher according to the present disclosure, and FIG. 2 is a schematic cross-sectional view schematically showing the inner structure of the dishwasher according to the present disclosure.

As illustrated in FIGS. 1 to 2, the dishwasher 1 according to the present disclosure comprises a case 10 forming the exterior of the dishwasher 1, a tub 20 being installed in the case 10, forming a wash space 21 in which a wash target is washed and having a front surface that is open, a door 30 opening and closing the open front surface of the tub 20, a driving part 40 being disposed under the tub 20 and supplying, collecting, circulating and draining wash water for washing a wash target, a storage part 50 being provided detachably in the wash space 21 in the tub 20 and allowing a wash target to be mounted on, and a spray part 60 being installed near the storage part 50 and spraying wash water for washing a wash target.

At this time, wash targets mounted in the storage part 50 may be cooking vessels such as bowls, dishes, spoons, chopsticks, and the like, and other cooking tools, for example. Hereafter, the wash targets are referred to as cooking vessels, unless mentioned otherwise.

The tub 20 may be formed into a box the front surface of which is open entirely, and may be a so-called tub.

The tub 20 may have a wash space 21 therein, and its open front surface may be opened and closed by the door 30

The tub 20 may be formed in a way that a metallic sheet having strong resistance against high-temperature and moisture, e.g., a stainless steel-based sheet, is pressed Additionally, a plurality of brackets may be disposed on the inner surfaces of the tub 20 and allow functional components such as a storage part 50, a spray part 60 and the like, which are described below, to be supported and installed in the tub 20.

The driving part 40 may comprise a sump 41 storing wash water, a sump cover 42 distinguishing the sump 41 from the tub 20, a water supply part 43 supplying wash water to the sump 41 from the outside, a drain part 44 discharging wash water of the sump 41 to the outside, and a water supply pump 45 and a supply channel 46 for supplying wash water of the sump 41 to the spray part 60.

The sump cover 42 may be disposed at the upper side of the sump 41, and distinguish the sump 41 from the tub 20. Additionally, the sump cover 42 may be provided with a plurality of return holes for returning wash water, having sprayed to the wash space 21 through the spray part 60, to the sump 41.

That is, wash water having sprayed toward cooking vessels from the spray part 60 may fall to the lower portion of the wash space 21 and return to the sump 41 through the sump cover 42.

The water supply pump 45 is provided in a lateral portion or the lower portion of the sump 41, and pressurizes wash water and supplies the same to the spray part 60.

One end of the water supply pump 45 may connect to the sump 41, and the other end may connect to the supply channel 46. The water supply pump 45 may have an impeller 451, a motor 453 and the like, therein. As power is supplied to the motor 453, the impeller 451 may rotate, and wash water of the sump 41 may be pressurized and then supplied to the spray part 60 through the supply channel 46.

The supply channel 46 may selectively supply the wash water supplied by the water supply pump 45 to the spray part 60.

For example, the supply channel 46 may comprise a first supply channel 461 connecting to a lower spray arm 61, and a second supply channel 463 connecting to an upper spray arm 62 and a top nozzle 63. The supply channel 46 may be provided with a supply channel diverting valve 465 selectively opening and closing the supply channels 461, 463.

At this time, the supply channel diverting valve 465 may be controlled to allow each of the supply channels 461, 463 to be opened consecutively or opened simultaneously.

The spray part 60 is provided to spray wash water to cooking vessels and the like stored in the storage part 50.

Specifically, the spray part 60 may comprise a lower spray arm 61 being disposed under the tub 20 and spraying wash water to a lower rack 51, an upper spray arm 62 being disposed between the lower rack 51 and an upper rack 52 and spraying wash water to the lower rack 51 and the upper rack 52, and a top nozzle 63 being disposed in the upper portion of the tub 20 and spraying wash water to a top rack 53 or the upper rack 52.

In particular, the lower spray arm 61 and the upper spray arm 62 may be provided in the wash space 21 of the tub 20, and spray wash water toward cooking vessels in the storage part 50 while rotating.

The lower spray arm 61 may be rotatably supported at the upper side of the sump cover 42 such that the lower spray arm 61 may spray wash water to the lower rack 51 while rotating under the lower rack 51.

Additionally, the upper spray arm 62 may be rotatably supported by a spray arm holder 467 such that the upper spray arm 62 may spray wash water while rotating between the lower rack 51 and the upper rack 52.

The tub 20 may be further provided with a reflection plate on a lower surface 25 thereof, to enhance washing efficiency, and the reflection plate diverts the direction of wash water having sprayed from the lower spray arm 61 to an upward direction (U-direction).

Since a well-known configuration can be applied to the configuration of the spray part 60, detailed description of the configuration of the spray part 60 is omitted hereafter.

The storage part 50 for storing cooking vessels may be provided in the wash space 21.

The storage part 50 may be withdrawn through the open front surface of the tub 20 from the inside of the tub 20.

For example, FIG. 2 shows an embodiment provided with a storage part comprising a lower rack 51 that is disposed in the lower portion of the tub 20 and stores relatively large-sized cooking vessels, an upper rack 52 that is disposed at the upper side of the lower rack 51 and stores medium-sized cooking vessels, and a top rack 53 that is disposed in the upper portion of the tub 20 and stores small-sized cooking vessels and the like. However, the subject matter of the present disclosure is not limited to the embodiment. Hereafter, a dishwasher that is provided with three storage parts 50, as illustrated, is described.

Each of the lower rack 51, the upper rack 52 and the top rack 53 may be withdrawn outward through the open front surface of the tub 20.

To this end, the tub 20 may have a guide rail 54, on both lateral walls thereof that form the inner circumferential surface of the tub 20, and for example, the guide rail 54 may comprise an upper rail 541, a lower rail 542, a top rail 543 and the like.

Each of the lower rack 51, the upper rack 52 and the top rack 53 may be provided thereunder with wheels. A user may withdraw the lower rack 51, the upper rack 52 and the top rack 53 outward through the front surface of the tub 20 to easily store cooking vessels on the racks or take out cooking vessels from the racks after a washing process.

The guide rail 54 may be provided as a fixed guide rail that guides the withdrawal and insertion of the spray part 60 in the form of a simple rail or as a stretchable guide rail which guides the withdrawal and storage of the spray part 60 and the withdrawal distance of which increases as the spray part 60 is withdrawn.

The door 30 is used for opening and closing the open front surface of the tub 20 that is described above.

Ordinarily, a hinge part for opening and closing the door 30 is provided in the lower portion of the open front surface, and the door 30 is open with respect to the hinge part as a rotation axis.

The door 30 may be provided with a handle 31 and a control panel 32 on the outer side surface thereof. The handle 31 is used for opening the door 30, and the control panel 32 is used for controlling the dishwasher 1.

As illustrated, the control panel 32 may be provided with a display 33 that visually displays information on a current operation state and the like of the dishwasher, and a button part 34 comprising a selection button to which the user's selection manipulation is input, a power button to which the user's manipulation for turning on-off the power source of the dishwasher is input, and the like.

The inner surface of the door 30 forms a mounting surface that can support the lower rack 51 of the storage part 50 as the door 30 is opened as well as forming one surface of the tub 20 as the door 30 is closed.

To this end, as the door 30 is fully opened, the inner surface of the door 30 forms a horizontal surface in the same direction where the guide rail 54, by which the lower rack 51 is guided, extends, for example.

The door 30 may be provided rotatably between a closed position and a fully-open position, and an intermediate still position may be formed between the closed position and the fully open position.

The door 30 may stand still at the intermediate still position, and at this time, the wash space 21 of the tub 20 may be open outward partially. When the door 30 is disposed at the intermediate still position, a dry air supply part 80 described hereafter may operate to supply high-temperature dry air or low-temperature dry air to the wash space 21.

Though not illustrated, the dry air supply part 80 may be provided under the tub 20 and generate high-temperature dry air and supply the high-temperature dry air into the tub 20.

[Detailed Configuration of Dry Air Supply Part]

Hereafter, the detained configuration of the above-described dry air supply part 80 is described with reference to FIGS. 3 to 5.

Figure 3:
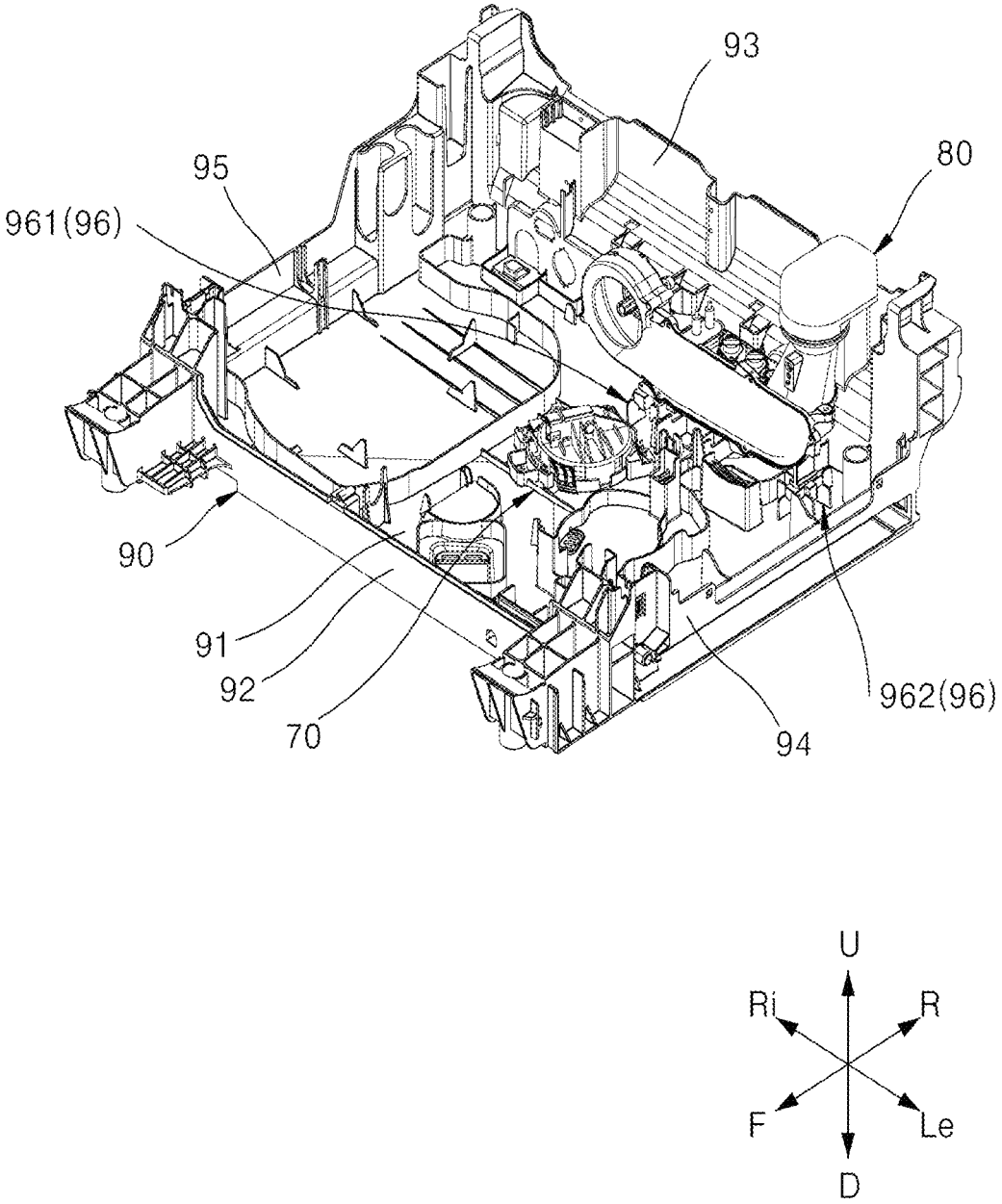
FIG. 3 is a front perspective view showing a dry air supply part of the dishwasher of one embodiment, which is accommodated in a base.

As illustrated in FIG. 3, the dry air supply part 80 may be accommodated in a base 90 and may be disposed to be supported by a lower surface 91 of the base 90.

For example, the dry air supply part 80 may be disposed in a position adjacent to a rear surface 93 of the base 90, and disposed in a position between a leakage detecting part and the rear surface 93 of the base 9X), approximately in parallel with the rear surface 93 of the base 90.

The position in which the dry air supply part is disposed may be selected considering the characteristics of the dry air supply part 80 that generates heat of 100° C. or greater in a high-temperature dry air supply mode. That is, the dry air supply part may be disposed to avoid electronic components that are greatly affected by high-temperature heat.

Additionally, the arrangement position of the dry air supply part may be selected based on the position of a dry air supply hole formed on the lower surface of the tub 20. That is, considering the user's safety, the dry air supply hole into which dry air flows may be formed at the corner of the lower surface of the tub 20, which is adjacent to the rear surface and the left side surface of the tub 20.

For the dry air supply part 80 to effectively generate dry air and supply the same to the dry air supply hole formed in the above-described position, the dry air supply part 80 may be disposed at the lower portion side of the dry air supply hole.

The arrangement position of the dry air supply part 80 is described exemplarily. The dry air supply part 80 may be disposed near a left side surface 94, a right side surface 95 or a front surface 92 of the base 90 rather than the rear surface 93 of the base 90. Hereafter, the dry air supply part 80 disposed near the rear surface 93 of the base 90 in parallel with the rear surface 93 is described, but the position of the dry air supply part 80 is not limited.

Figure 4:
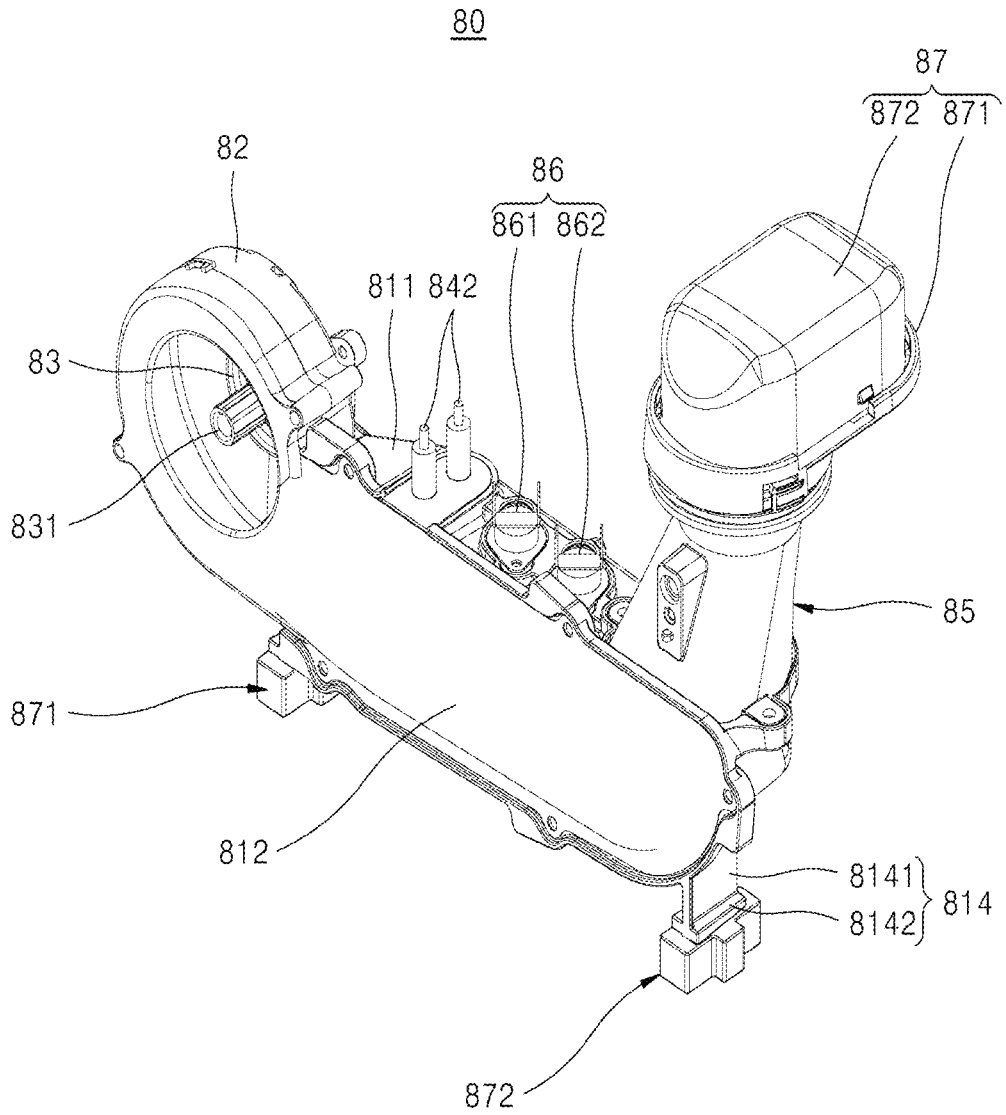
FIG. 4 is a front perspective view showing the dry air supply part in FIG. 3.
Figure 5:
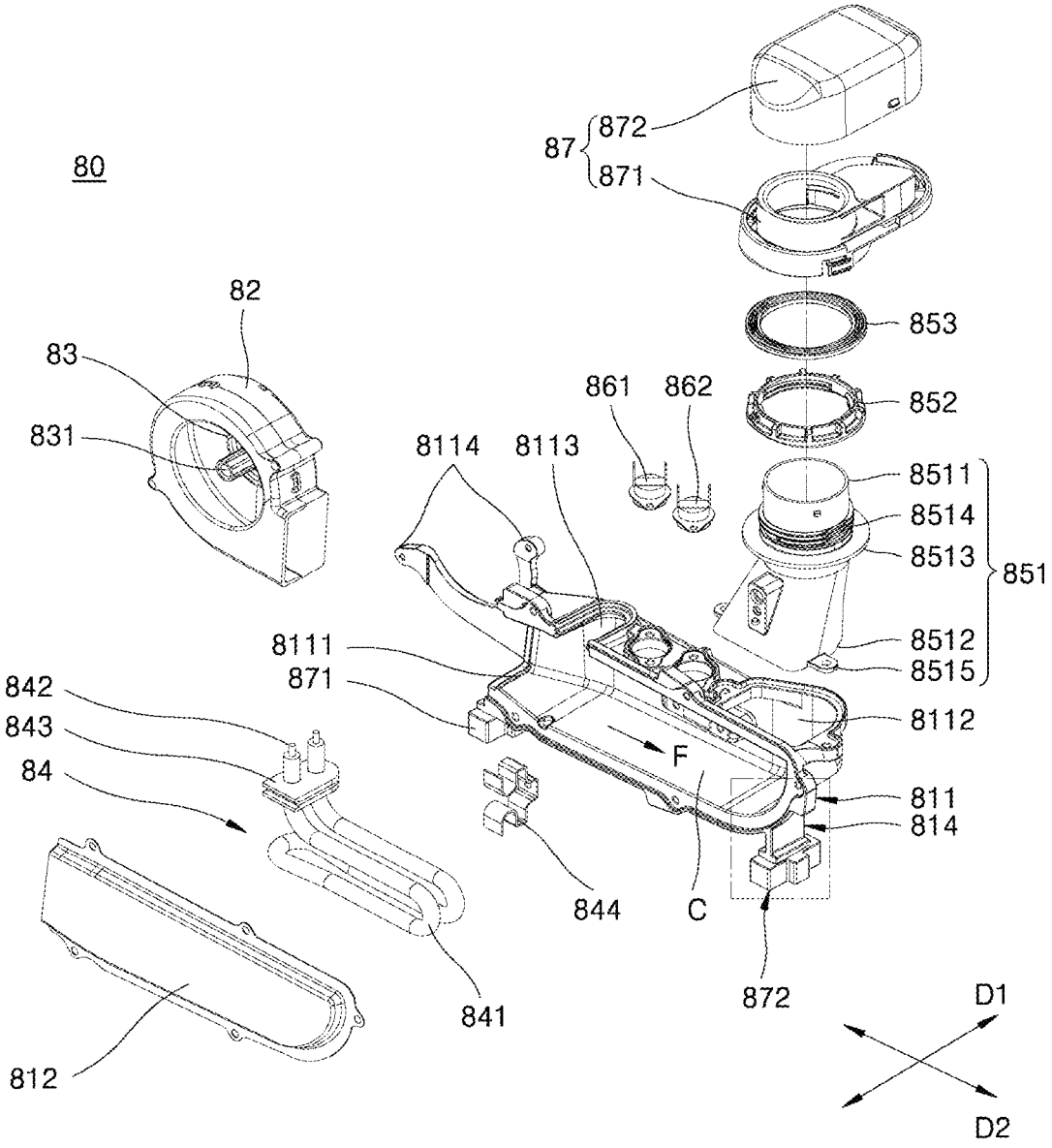
FIG. 5 is an exploded perspective view of FIG. 4.

FIGS. 4 and 5 show a detailed configuration of the dry air supply part 80.

As illustrated, the dry air supply part 80 generating dry air and supplying the same into the tub 20 may comprise an air blowing fan that generates dry airflow to be supplied into the tub 20, an air blowing motor 83 that generates rotational driving force of the air blowing fan, a heater 84 that heats dry air, and a heater housing 81 in which an air passage C is formed.

The air blowing fan is disposed at the upstream side in the direction of dry airflow at an inlet 8111 side of the heater housing 81, and accelerates air to the air passage C formed in the heater housing 81 to generate dry airflow.

The air blowing motor 83 generating rotational driving force of the air blowing fan may be modularized with the air blowing fan and accommodated in the fan housing 82.

The type of the air blowing fan to be applied to the dry air supply part 80 is not limited, but a sirocco fan, for example, may be used considering the position and space limitations in the installation of the air blowing fan.

When a sirocco fan is applied as shown in the illustrative embodiment, external air may be suctioned, in a direction parallel a direction from the center of the sirocco fan to the rotation axis 831 of the same, and be accelerated and discharged outward in the radial direction. The accelerated and discharged air may form dry airflow and be drawn into the air passage C in the heater housing 81 through the fan housing 82 and the inlet 8111 of the heater housing 81.

The fan housing 82, as illustrated, may be fixed to a connection tab 8114 provided at the heater housing 81 through a fastening means such as a screw bolt, and the like, for example.

The heater 84 is disposed in the air passage C of the heater housing 81, and for example, is directly exposed to dry airflow F in the air passage C and heats the dry airflow F.

When the dry air supply part 80 supplies high-temperature dry air, power may be supplied to the heater 84, and the heater may heat dry air, and when the dry air supply part 80 supplies low-temperature dry air, the supply of power to the heater 84 may be cut off, and the heater 84 may stop operating.

At this time, when low-temperature dry air is supplied, the air blowing motor 83 may keep operating to generate dry airflow F.

The type of the heater 84 provided in the dry air supply part 80 of one embodiment is not limited, but a tube-type sheath heater may be selected since the sheath heater has a relatively simple structure, ensures excellent heat generation efficiency and as described below, and helps to prevent electric leakage caused by the reverse inflow of wash water that comes in from the tub 20 reversely, for example.

To enhance heat exchange efficiency, the heater main body 841 may have a stereoscopic shape having a plurality of bends, to be directly exposed to dry airflow F at the air passage C in the heater housing 81 and ensure a heat transfer surface.

One end portion and the other end portion of the heater main body 841 may pass through the upper surface of the heater housing 81 and extend upward.

Additionally, a pair of terminals 842 for receiving power may be formed in one end portion and the other end portion of the heater main body 841

As illustrated, the pair of terminals 842 may be installed in and fixed to the heater housing 81 through a terminal fixation part 843. At this time, a fixation slot 8113 may be provide on the upper surface of the heater housing 81 such that the terminal fixation part 843 may be coupled in a sliding manner.

Further, a main body support part 844 for firmly supporting the heater main body 841 on the air passage C may be disposed in the heater housing 81. As illustrated in FIG. 5, the main body support part 844 may be formed in a way that a metallic plate is pressed to have a shape corresponding to the outer side surface of the heater main body 841 having a tube shape.

Further, as illustrated in FIGS. 4 and 5, a temperature sensor as a temperature sensing part 86 sensing the temperature of high-temperature dry air generated through the heater 84 or detecting the overheating of the heater 84 may be provided on the upper side surface of the housing main body 811 of the heater housing 81.

For example, the temperature sensor may comprise a thermistor 861 that senses the temperature of dry air, and a thermostat 862 that detects the overheating of the heater 84.

An output signal of the temperature sensor may be delivered to a non-illustrated controller, and the controller may receive the output signal of the temperature sensor to determine the temperature of high-temperature dry air and the overheating of the heater 84. As the heater 84 overheats, the controller may cut off the supply of power to the heater 84 and change the operation mode of the dry air supply part 80 from a high-temperature dry air supply mode to a low-temperature dry air supply mode.

The heater housing 81 comprises a housing main body 811 in which an air passage C provided with an inlet 8111 and an outlet 8112 is formed.

The heater housing 81 may be formed approximately into a cuboid box having an air passage C therein.

Specifically, the longitudinal D2 length of the heater housing 81 from the inlet 8111, formed at the front end side of the heater housing 81, to the outlet 8112, formed at the rear end side of the heater housing 81, may be greater than the transverse D1 length perpendicular to the longitudinal D2 length, with respect to the direction of the flow of dry airflow.

Accordingly, the length of the air passage C may be maximized with respect to the direction of the flow of dry airflow to improve efficiency of the heat exchange with the heater 84 disposed in the heater housing 81.

In the illustrative embodiment, the front surface and the right side surface of the heater housing 81 are open entirely.

The right side surface, which is the front end with respect to the direction of the flow of dry airflow, is entirely open, forms the inlet 8111 of the air passage C and makes a fluid connection with the above-described fan housing 82.

A housing cover 812 may be coupled to the open front surface, and the open front surface may be closed. As described below, an expansion surface 8116 may be provided at the edge of the open front surface and formed into a flange. The housing cover 812 is coupled to the expansion surface 8116, and the expansion surface 8116 helps to increase a surface of contact or coupling with the housing cover 812.

The outlet 8112 of the air passage C may be formed at the rear end side of the heater housing 81, with respect to the direction of the flow of dry airflow. At this time, the outlet 8112 may be formed on the upper side surface of the housing main body 811, near the rear end of the heater housing 81, for example.

As described above, the heater 84 generating high-temperature heat is accommodated in the housing main body 811. The housing main body 811 may be made of a material appropriate for a high-temperature environment created by the heater 84 accommodated therein, for example, a light-weight metallic material.

Additionally, the dry air supply part 80 may further comprise a connection duct part 85 that is coupled to the outlet 8112 side of the heater housing 81 and has an air passage therein.

As described above, the heater housing 81 and the air blowing fan are disposed at the lower portion side of the lower surface of the tub 20. The connection duct part 85 may guide dry air discharged from the heater housing 81 to a predetermined position, i.e., the dry air supply hole of the tub 20.

For example, the predetermined position may be the lower surface of the tub 20, and the dry air supply hole into which dry airflow F guided to the connection duct part 85 is drawn may be formed at the corner of the lower surface of the tub 20, which is adjacent to the rear surface and the left side surface of the tub 20.

A duct main body 851 of the connection duct part 85, as shown in the illustrative embodiment, may have a shape that connects the dry air supply hole of the tub 20 and the outlet 8112 of the heater housing 81.

For example, the duct main body 851 of the connection duct part 85 may be formed into a cylinder a lower end portion 8512 of which communicates with the outlet 8112 of the heater housing 81 and an upper end portion 8511 of which extends perpendicularly and connects to the dry air supply hole.

A fastening tab 8515 for fastening and fixing to the heater housing 81 may be provided at a plurality of spots of the lower end portion 8512 of the duct main body 851.

Additionally, considering the shape of the outlet 8112 of the heater housing 81, the lower end portion 8512 of the duct main body 851 may be formed into a rectangular container, and to prevent leakage of water, the upper end portion 8511 of the duct main body 851 may be formed into a cylinder. That is, to ensure coupling efficiency and water leakage prevention between the upper end portion 8511 of the duct main body 851 and the dry air supply hole of the tub 20, the duct main body 851 may be formed into a cylinder.

As a means of ensuring coupling efficiency and water leakage prevention, a ring-type flange 8513 and a male screw part 8514 may be provided at the upper end portion side 8511 of the duct main body 851.

The upper end portion 8511 of the duct main body 851 may pass through the lower surface of the tub 20 and extend in the upward direction (U-direction), and the upper end portion 8511 of the duct main body 851 and the male screw part 8514 may pass through the lower surface of the tub 20 at least partially and protrude toward the inside of the tub 20.

A fastening nut 852 is coupled to the male screw part 8514 that is disposed by passing through the inside of the tub 20.

At a time of fixing and fastening the duct main body 851, the fastening nut 852 is screw-coupled to the male screw part 8514, in the tub 20, such that the upper end portion 8511 of the duct main body 851 may be fixed in the state of being exposed to the inside of the tub 20.

That is, the fastening nut 852 contacts the upper portion side of the lower surface of the tub 20 closely, and the ring-type flange 8513 receives the force of being pulled toward the lower surface of the tub 20 because of the coupling force of the fastening nut 852, in close contact with the lower portion side of the lower surface of the tub 20. By doing so, the adhesive force between the flange 8513 and the lower surface of the tub 20 increases. Accordingly, it is much less likely that wash water leaks through the outer circumferential surface of the duct main body 851. As a means of promoting the effect of preventing leakage of wash water, an airtight ring 853 made of an elastic material may be further provided between the flange 8513 and the lower surface of the tub 20.

Additionally, the connection duct part 85 fixes the heater housing 81 as well as guiding dry airflow F.

That is, as the upper end portion 8511 of the duct main body 851 is fixed to the tub 20 through the fastening nut 852, the up-down movement of the rear end side of the heater housing 81 is limited and fixed by the duct main body 851.

By doing so, without an additional fastening means, a support structure for the upper portion side of the dry air supply part 80 may be achieved.

A support structure for the lower portion side of the dry air supply part 80 may be achieved by a damper and a support rib 96 of the base 90, as described below.

The dry air supply part 80 of one embodiment may further comprise an airflow guide 87 that diverts the direction of dry airflow to be supplied through the duct main body 851.

As illustrated in FIG. 4, the airflow guide 87 may comprise a lower guide 871 that is fitted and coupled to the upper end portion 8511 of the duct main body 851, and an upper guide 872 that is coupled to the upper side of the lower guide 871.

A channel diverting structure that diverts the direction of dry airflow may be formed between the lower guide 871 and the upper guide 872.

The airflow guide 87 is directly exposed to the wash space 21 that is formed in the tub 20. Accordingly, some wash water scattered in the washing stage or the rinsing stage is likely to flow into the heater housing 81 reversely through the airflow guide 87. A means of preventing and minimizing the flow of wash water into the airflow guide 87 may be provided at the airflow guide 87.

Additionally, a drain hole for discharging reversely incoming wash water may be provided in the heater housing 81.

Further, the dry air supply part 80 of the dishwasher 1 of one embodiment may further comprise a plurality of legs 813, 814 for keeping the heater housing 81 spaced upward from the lower surface 91 of the base 90.

Since the heater housing 81 generating high-temperature heat is spaced from the base 90 through the plurality of legs 813, 814 as described above, the heat directly transferred to the base 90 through the heater housing 81 may be minimized.

As illustrated, the plurality of legs 813, 814 may comprise a first leg 813 one end portion of which connects to the lower portion side of the inlet 8111 of the heater housing 81 and the other end portion of which extends toward the lower surface 91 of the base 90, and a second leg 814 one end portion of which connects to the lower portion side of the outlet 8112 of the heater housing 81 and the other end portion of which extends toward the lower surface 91 of the base 90.

Since the longitudinal D2 length of the heater housing 81 is much greater than the transverse D1 length as described above, the first leg 813 and the second leg 814 may be spaced farthest from each other in the longitudinal direction D2 such that the heater housing 81 is effectively supported.

For the first leg 813 and the second leg 814 to be spaced farthest from each other, one end portion of a perpendicular extension part 8131 of the first leg 813 may be fixed to the lower portion side of the inlet 8111 of the heater housing 81, and one end portion of a perpendicular extension part of the second leg 814 may be fixed to the lower portion side of the outlet 8112 of the heater housing 81, using a method such as welding and the like.

The first leg 813 and the second leg 814 may be made of a lightweight metallic material appropriate for a high-temperature environment similar to the environment of the heater housing 81, and for example, formed into a sheet having a transverse D1 width greater than a longitudinal D2 thickness.

[Detailed Configuration of Tub and Airflow Guide]

Hereafter, detailed configurations of the tub 20 and the airflow guide 87 of the dishwasher 1 of one embodiment are described with reference to FIGS. 6 to 21C.

Figure 6:
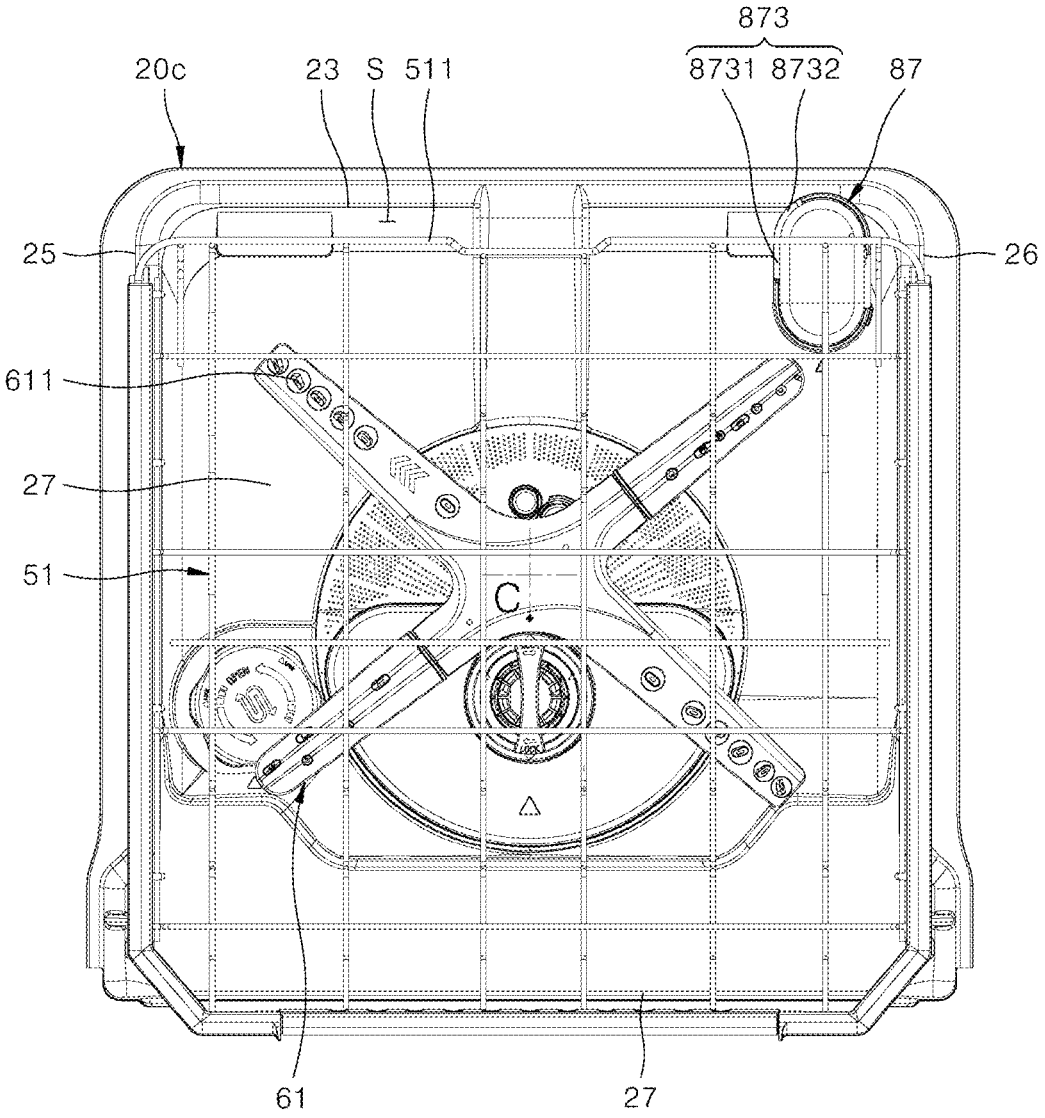
FIG. 6 is a plan view showing a bottom tub provided with an airflow guide of the dishwasher of one embodiment.

Referring to FIG. 6, the tub 20 forming the wash space 21 of the dishwasher 1 may be comprised of a plurality of parts. The tub 20 may be comprised of three parts, for example, but not limited. A tub 20 comprised of three parts is described as an example.

The tub 20 comprised of three parts may comprise an upper tub forming the upper surface of the tub 20, a bottom tub 20*c* forming the lower surface 25 of the tub 20, and a mid tub disposed between the upper tub and the bottom tub 20*c* and coupled respectively to the upper tub and the bottom tub 20*c*.

The upper tub forming the upper surface of the tub 20 may be formed in a way that a metallic sheet having predetermined heat resistance and corrosion resistance, for example, a stainless steel sheet, is pressed.

At this time, both lateral surface edges and the rear edge of the upper tub coupled to the mid tub may be formed into a curved surface having predetermined curvature.

Like the upper tub, the bottom tub 20*c* forming the lower surface 25 of the tub 20 may be formed in a way that a metallic sheet having predetermined heat resistance and corrosion resistance, for example, a stainless steel sheet, is pressed.

At this time, both lateral surface edges and the rear edge of the bottom tub 20*c* coupled to the mid tub may be formed into a curved surface having predetermined curvature. To be effectively coupled to the mid tub, both the lateral surface edges and the rear edge of the bottom tub 20*c* may form a portion of a rear surface 23, a left side surface 26 and a right side surface 27 of the tub 20.

Additionally, a sump hole 252 for mounting the sump 41 storing wash water may be formed in the central portion of the bottom tub 20*c*, and the lower surface 25 of the bottom tub 20*c* may be provided with a convergence surface 251 having a downward slope toward the sump hole 252.

The sump 41 storing wash water, and the sump cover 42 dividing the sump 41 and the bottom tub 20*c* may be disposed in the sump hole 252.

The base 90 having a predetermined accommodation space therein may be coupled to the lower portion side of the bottom tub 20*c*.

Like the upper tub and the bottom tub 20*c*, the mid tub forming both the lateral surfaces 26, 27 and the rear surface 23 of the tub 20 may be formed in a way that a metallic sheet having predetermined heat resistance and corrosion resistance, for example, a stainless steel sheet, is pressed.

Both the lateral surface edges and the rear surface edge of the upper tub may be coupled to the upper end edge of the mid tub.

Additionally, both the lateral surface edges and the rear surface edge of the bottom tub 20*c* may be coupled to the lower end edge of the mid tub.

At this time, to prevent the leakage of wash water and ensure a mutually firm coupling, the upper tub and the mid tub, and the mid tub and the bottom tub 20*c* may be mutually coupled based on welding, e.g., seam welding.

Herein, seam welding as sort of electric resistance welding involves continuous spot welding with a roller-shaped electrode, and is used for an airtight seam and a watertight seam, as is well-known in the art.

Although the tub 20 is comprised of three parts including the upper tub, the mid tub and the bottom tub 20*c*, a welding line may be formed on the same flat surface in the seam welding method. Thus, the seam welding process may require less time than any other welding process.

The lower spray arm 61 may be rotatably disposed at the upper side of the sump hole 252, as illustrated in FIG. 6.

The lower spray arm 61 is rotatably disposed right under a lower rack 51, and while rotating, sprays wash water toward the lower rack 51.

The lower spray arm 61 may be rotatably supported by the sump 41, and wash water pressurized through the sump 41 may be supplied to the lower spray arm 61.

A plurality of nozzles 611 for spraying wash water to the lower rack 51 may be provided on the upper surface of the lower spray arm 61.

The directionality of a portion of the plurality of nozzles 611 may be set such that a portion of the plurality of nozzles 611 spray wash water upward toward the lower surface of the lower rack 51.

As illustrated in FIGS. 6 to 9, the airflow guide 87 may be disposed between the lower surface 25 of the bottom tub 20*c* and the lower rack 51, near the lower surface 25 of the bottom tub 20*c*, and divert the direction of the flow of dry airflow F supplied through the duct mam body 851.

Specifically, the airflow guide 87 may be disposed near the corner formed between the left side surface 26 and the rear surface 23 of the bottom tub 20*c* or near the corner formed between the right side surface 27 and the rear surface 23 of the bottom tub 20*c*. In response to the position of the airflow guide 87, the above-described dry air supply hole 253 for transferring dry air may be formed on the lower surface 25 of the bottom tub 20*c*.

FIGS. 1 to 6 show that the airflow guide 87 and the dry air supply hole 253 are adjacent to the lower surface 25 of the bottom tub 20*c*, near the corner formed between the left side surface 26 and the rear surface 23 of the bottom tub 20*c*, for example. Hereafter, for convenience, the airflow guide 87 and the dry air supply hole 253, which are disposed near the corner formed between the left side surface 26 and the rear surface 23 of the bottom tub 20*c* as illustrated, are described as an example, but not limited.

The corner formed between the left side surface 26 and the rear surface 23 of the bottom tub 20*c* is a position farthest from the upper end of the front surface 22 of the tub 20 that is partially open in the drying stage.

Thus, the period for which dry air sprayed from the airflow guide 87 remains in the tub 20 may extend effectively. By doing so, dry air may be supplied to the lower rack 51, the upper rack 52 and the top rack 53 evenly and then discharged through the upper end of the front surface of the tub, enabling thermal energy of the dry air to be transferred to wash targets effectively and significantly promoting the effect of drying the wash targets.

Figure 9:
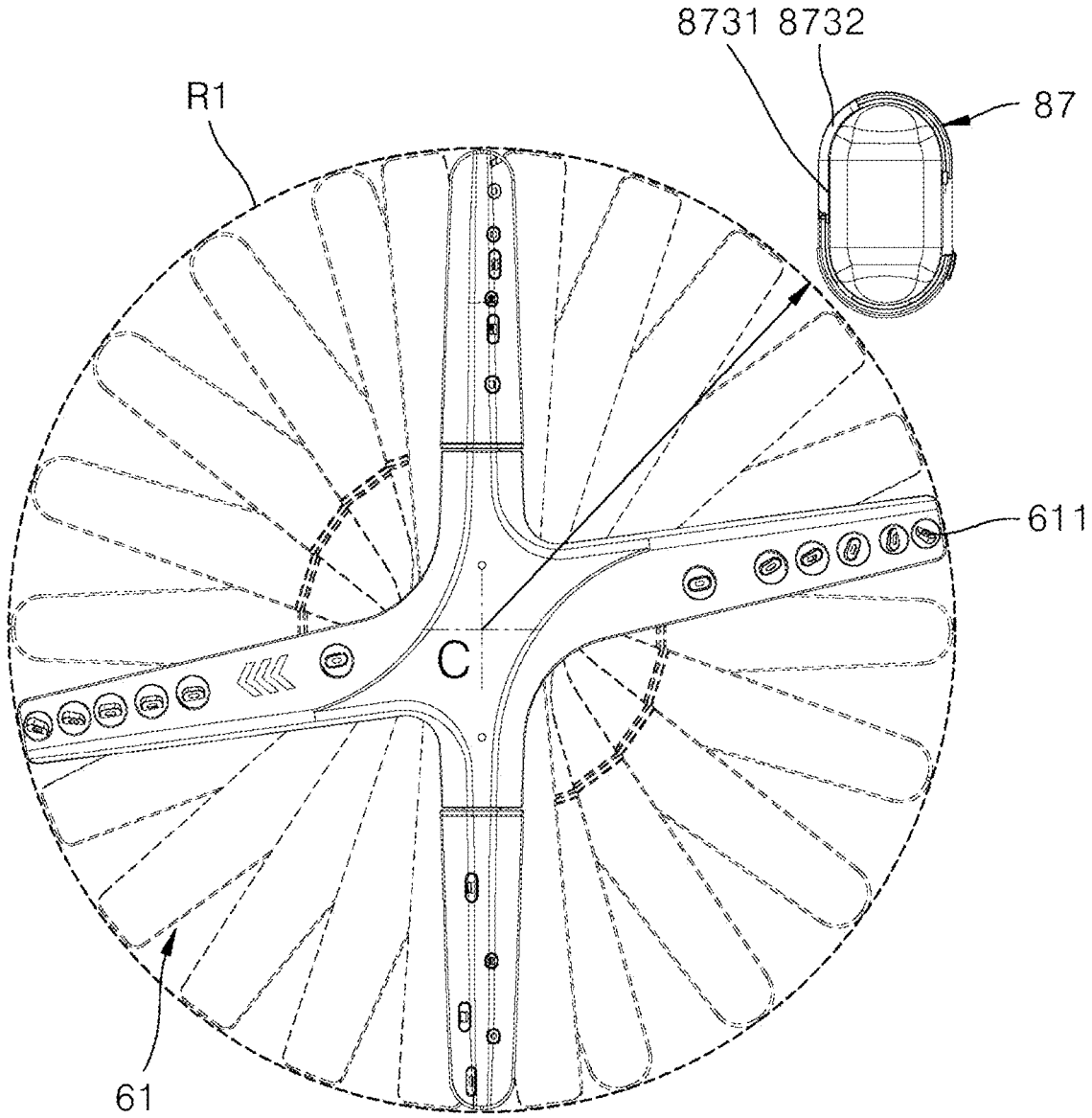
FIG. 9 is a plan view showing a relative position of a lower spray arm and an airflow guide.

As illustrated in FIG. 9, the airflow guide 87 may be disposed outside the rotation range R1 of the lower spray arm 61, and separated and spaced from the rear surface 23, the lower surface 25 and the left side surface 26 of the bottom tub 20*c*.

That is, the airflow guide 87 may be disposed between the corner gathered and formed by the rear surface 23, the lower surface 27 and the left side surface 26 of the bottom tub 20*c*, and the rotation rage of the lower spray arm 61.

Since the airflow guide 87 is disposed at the corner of the bottom tub 20*c*, outside the rotation range R1 of the lower spray arm 61, as described above, interference with the lower spray arm 61 rotating in the washing stage or the rinsing stage may be prevented effectively.

Additionally, since the airflow guide 87 is spaced a predetermined distance apart from the rear surface 23, the lower surface 25 and the left side surface 26 of the bottom tub 20*c*, food and the like may be effectively prevented from being fitted and fixed between the airflow guide 87 and the bottom tub 20*c*.

The period for which dry air remains in the tub 20 may further increase, based on the adjustment of the direction of the spray of dry air from the airflow guide 87.

That is, a discharge opening 873 of the airflow guide 87, from which dry air sprays, may be formed in a position where dry air does not directly spray toward the lower rack 51 and wash targets stored on the lower rack 51.

Specifically, the airflow guide 87 of the dishwasher 1 of one embodiment may discharge dry air in a direction that is not the upward direction (U-direction) perpendicular to the lower surface 25 of the bottom tub 20*c* or the direction in which dry air does not spray directly toward the lower rack 51.

To this end, the discharge opening 873 from which dry air sprays may be formed on the right surface of the airflow guide 87 to discharge dry air in a direction approximately parallel with the rear surface 23 of the bottom tub 20*c*.

Figure 7:
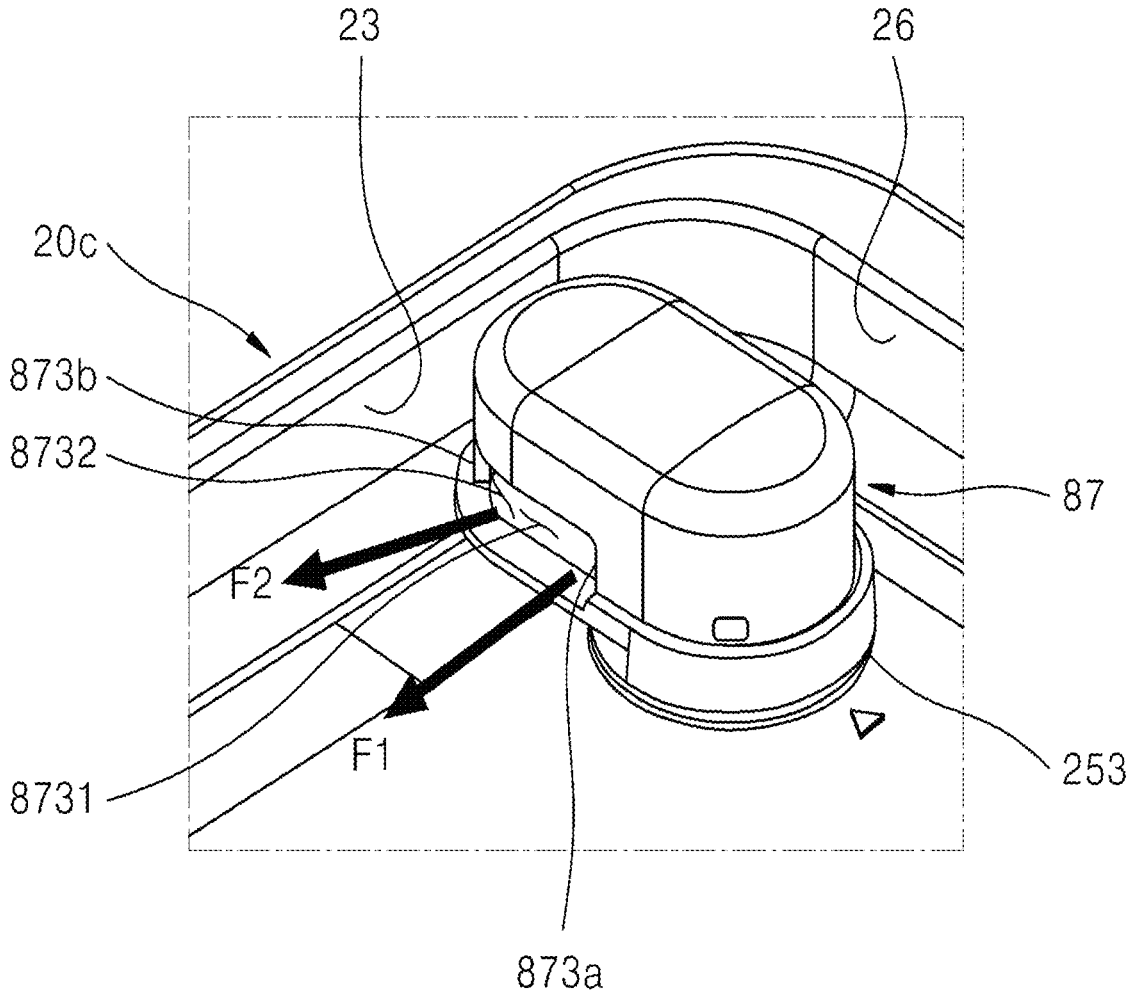
FIGS. 7 and 8 are partial enlarged views of FIG. 6.
Figure 8:
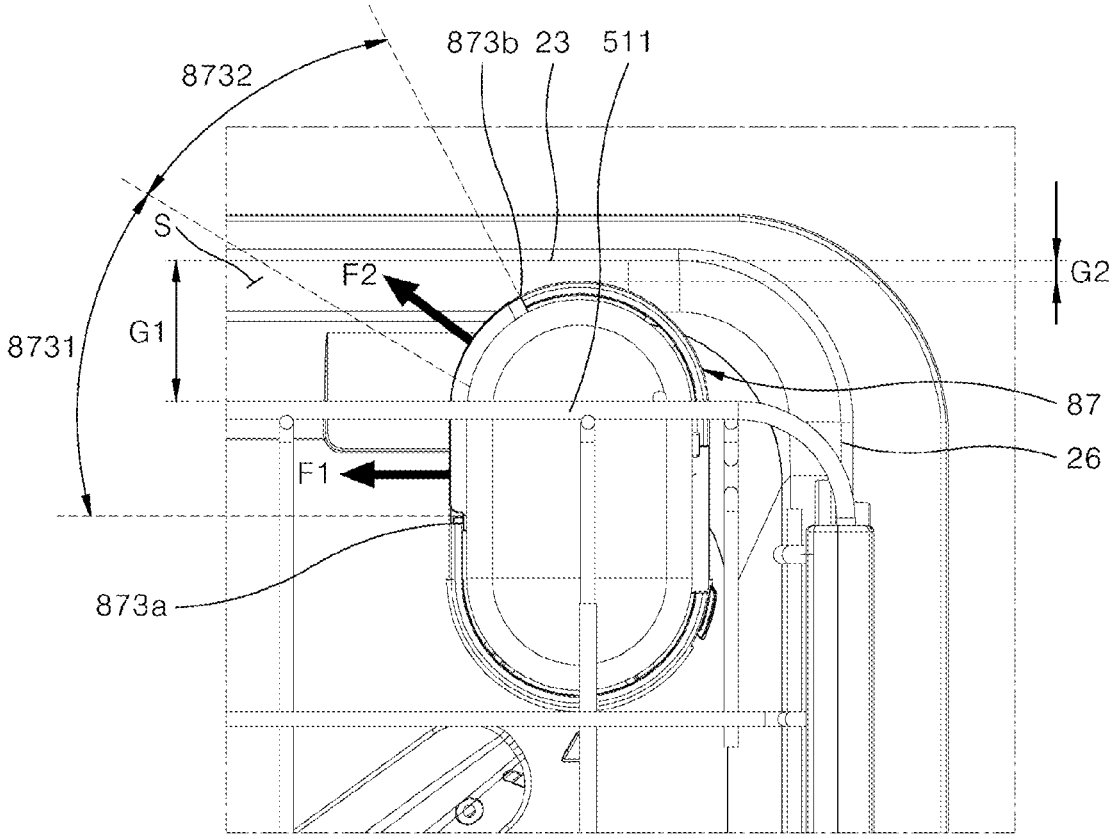

As illustrated in FIGS. 7 and 8, the front-rear (F-R direction) width of the airflow guide 87 may be greater than the left-right (Le-Ri direction) width in the state where the airflow guide 87 is coupled to the duct main body 851 of the connection duct part 85, and the discharge opening 873 may be formed continuously throughout the right side surface of the guide 87, facing the right side surface 27 of the bottom tub 20*c*, and the rear surface of the guide 87. That is, the discharge opening 873 of the airflow guide 87 may have the directionality that does not face the door directly and face the front surface 22 of the tub 20*c* or the door 30 linearly.

At this time, the discharge opening 873 of the airflow guide 87 may be formed into a slit or have an oblong shape the up-down (U-D direction) height of which is less than the front-rear (F-R direction) length. Additionally, for dry air to spray in a lowermost position, the up-down (U-D direction) height of the discharge opening 873 may remain constant in the front-rear direction (F-R direction).

Additionally, as illustrated, a front edge 873*a* of the discharge opening 873 may be formed on the right side surface of the airflow guide 87, having a flat plate shape, and a rear edge 873*b* may extend to the rear surface of the airflow guide 87, having a curved surface shape.

Accordingly, dry air sprayed through the discharge opening 873 may be discharged in the lowest position with respect to the up-down direction (U-D direction), and based on the slit shape of the discharge opening, have directionality, which is approximately parallel with the rear surface 23 of the bottom tub 20*c* with respect to the horizontal direction and does not face the door 30 linearly, and spray.

Further, to promote the effect of distributing dry air sprayed through the discharge opening 873, the discharge opening 873 may extend from the lower portion of the lower rack 51, between a space S formed between the lower rack 51 and the rear surface 23 of the bottom tub 20*c*.

That is, at least a portion of dry air sprayed through the slit-shaped discharge opening 873 may spray toward between the lower surface 27 of the bottom tub 20*c* and the lower rack 51, and the remaining portion of the dry air may spray toward the space S.

To this end, the airflow guide 87, as illustrated in FIG. 8, may be disposed closer to the rear surface 23 of the bottom tub 20*c* than the lower rack 51. Specifically, when a rear end portion 511 of the lower rack 51 is spaced a first distance G1 apart from the rear surface 23 of the bottom tub 20*c* in the state where the lower rack 51 is stored in the wash space, the rear end portion of the airflow guide 87 may be spaced from the rear surface 23 of the bottom tub 20*c* to have a second distance G2 less than the first distance G1.

At this time, the front edge 873*a* of the slit-shaped discharge opening 873 may be disposed under the lower rack 51, and the rear edge 873*b* of the discharge opening 873 may be disposed in the space S.

In other words, the discharge opening 873 of the airflow guide 87, as illustrated in FIG. 8, may be divided into a first portion 8731 disposed under the lower rack 51, and a second portion 8732 disposed in the space S, and the rear end portion 511 of the lower rack 51 may be a reference line dividing the first portion 8731 and the second portion 8732.

By doing so, dry air may spray in a direction that does not face the center of the lower rack 51 directly, or a direction that avoids the lower rack 51, and dry airflow F1 having passed through the first portion 8731 may move up toward the lower surface of the lower rack 51, and dry airflow F2 having passed through the second portion 8732 may move up by passing through the space S.

Thus, the thermal energy of dry air may be distributed evenly in the tub 20 without concentrating on a specific portion of the lower rack 51.

A relative ratio of the first portion 8731 and the second portion 8732 may be set differently depending on a required distribution ratio of dry air. That is, when more dry air needs to be supplied to the lower rack 51, a surface area ratio of the first portion 8731 may increase, and when more dry air needs to be supplied to the space S, a surface area ratio of the second portion 8732 may increase.

However, since the capacity of the lower rack 51 is ordinarily much greater than the capacity of the upper rack 52 or the top rack 53, the surface area ratio of the first portion 8731 is greater than the surface area ratio of the second portion 8732, for example.

Considering the fact, the surface area of the second portion 8732, escaping from the rear end portion 511 of the lower rack 51 and being disposed in the space S, may account for 25% to 50% of the entire surface area of the discharge opening 873 of the airflow guide 87.

Further, since the rear edge 873*b* of the discharge opening 873, as illustrated in FIGS. 7 and 8, extends to the rear surface of the airflow guide 87, at least a portion of dry airflow sprayed at the rear edge 873*b* side of the discharge opening 873 may have directionality facing the rear surface 23 of the bottom tub 20*c*.

Figure 10A:
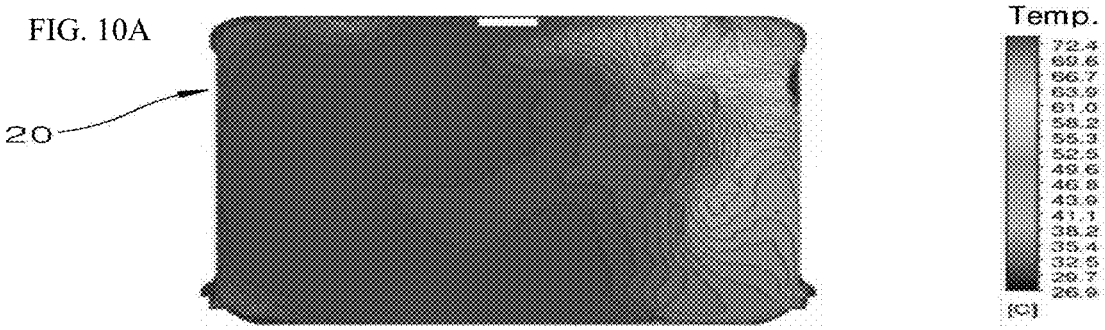
FIGS. 10A to 10C show experimental data on the distribution of measured temperatures in a drying process of the related art.
Figure 10B:
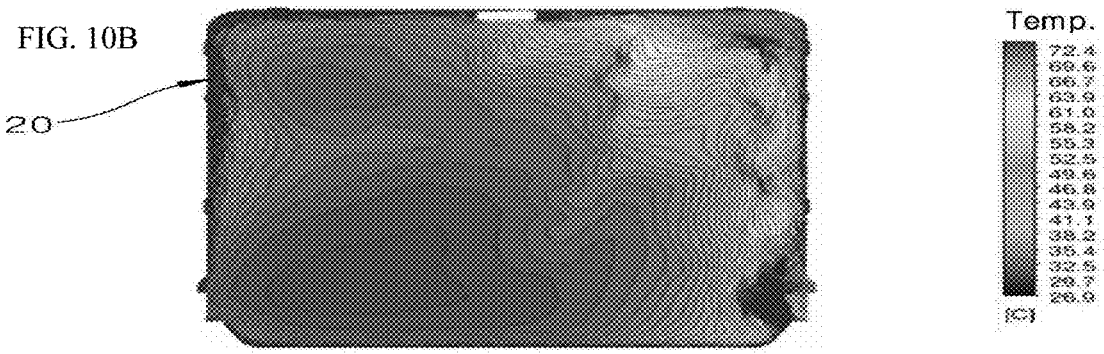
Figure 10C:
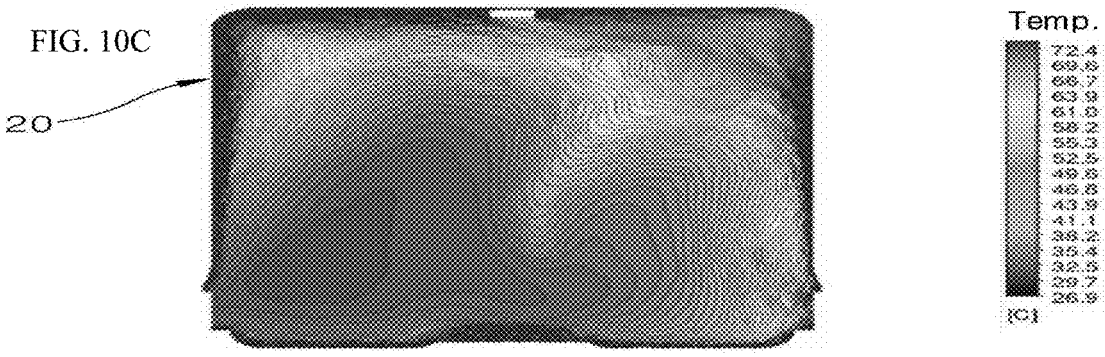
Figure 11A:
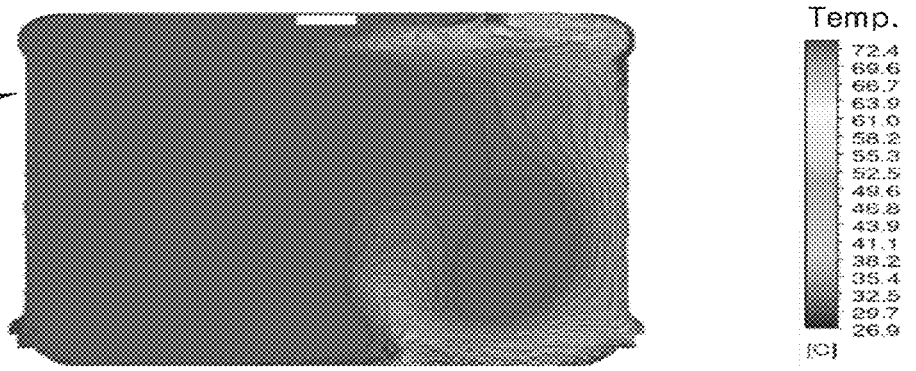
FIGS. 11A to 11C show experimental data on the distribution of measured temperatures in a drying process of one embodiment.
Figure 11B:
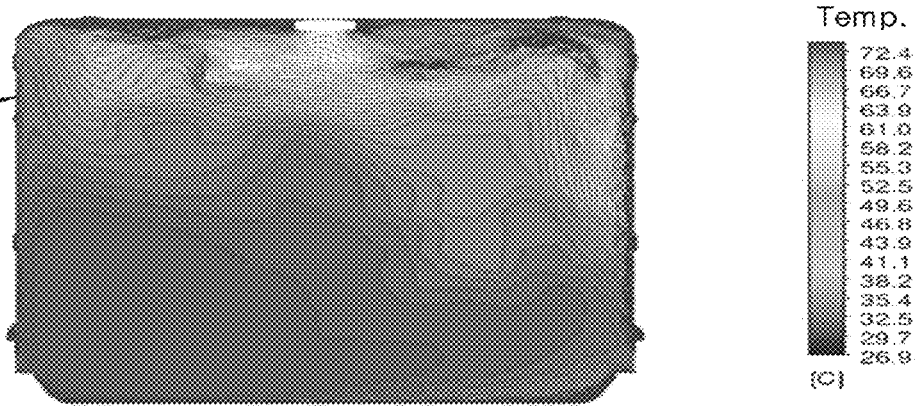
Figure 11C:
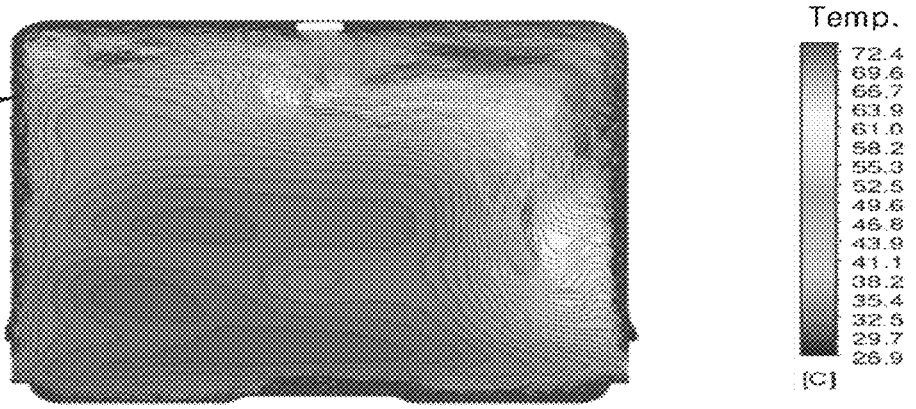

FIGS. 10A to 10C are views showing temperature distribution measured respectively at a top rack 53, an upper rack 52 and a lower rack 51 in the state where dry air is supplied through an airflow guide 87 of the related art, and FIGS. 11A to 11C are views showing temperature distribution measured respectively at the top rack 53, the upper rack 52 and the lower rack 51 in the state where dry air is supplied through the airflow guide 87 of one embodiment.

The experiment on the comparative example of the related art in FIGS. 10A to 10C, and the experiment on the experimental example of one embodiment in FIGS. 11A to 11C were performed under the same test conditions, except for the direction in which dry air sprays.

As illustrated in FIGS. 10A to 10C, when the airflow guide 87 is disposed near the lower surface 25 of the bottom tub 20*c* or dry air sprays toward the central portion of the bottom tub 20*c*, in the related art, there is no big temperature deviation in each position of the lower rack 51 (FIG. 10A).

However, the temperature deviation in each position of the upper rack 52 and the top rack 53 reveals that temperature decreases rapidly from the central portion of the upper rack 52 and the top rack 53 to the outer side of the upper rack 52 and the top rack 53, and there is a big deviation between the central portion and the outer side (FIG. 10B and FIG. 10C).

As illustrated in FIGS. 1A to 11C, when the airflow guide 87 is disposed near the lower surface 25 of the bottom tub 20*c* or dry air sprays in a direction parallel with the rear surface 23 of the bottom tub 20*c* and is distributed evenly, in the present disclosure, there is not big temperature deviation in each position of the lower rack 51 (FIG. 11A).

Additionally, while the temperature deviation in each position of the upper rack 52 and the top rack 53 reveals that temperature decreases gradually from the central portion of the upper rack 52 and the top rack 53 to the outer side of the upper rack 52 and the top rack 53, there is no rapid decrease in the temperature and there is no big deviation between the central portion and the outer side.

In particular, unlike the related art, the present disclosure shows that the temperature of the central portion of the top rack 53 also remains quite high, that the temperature of dry air sprayed by the airflow guide 87 of one embodiment remains constant in the tub 20 entirely and that the effect of drying wash targets is promoted noticeably.

Hereafter, a detailed configuration of the airflow guide 87 of the dishwasher 1 of one embodiment is described with reference to FIGS. 12 to 16.

Figure 12:
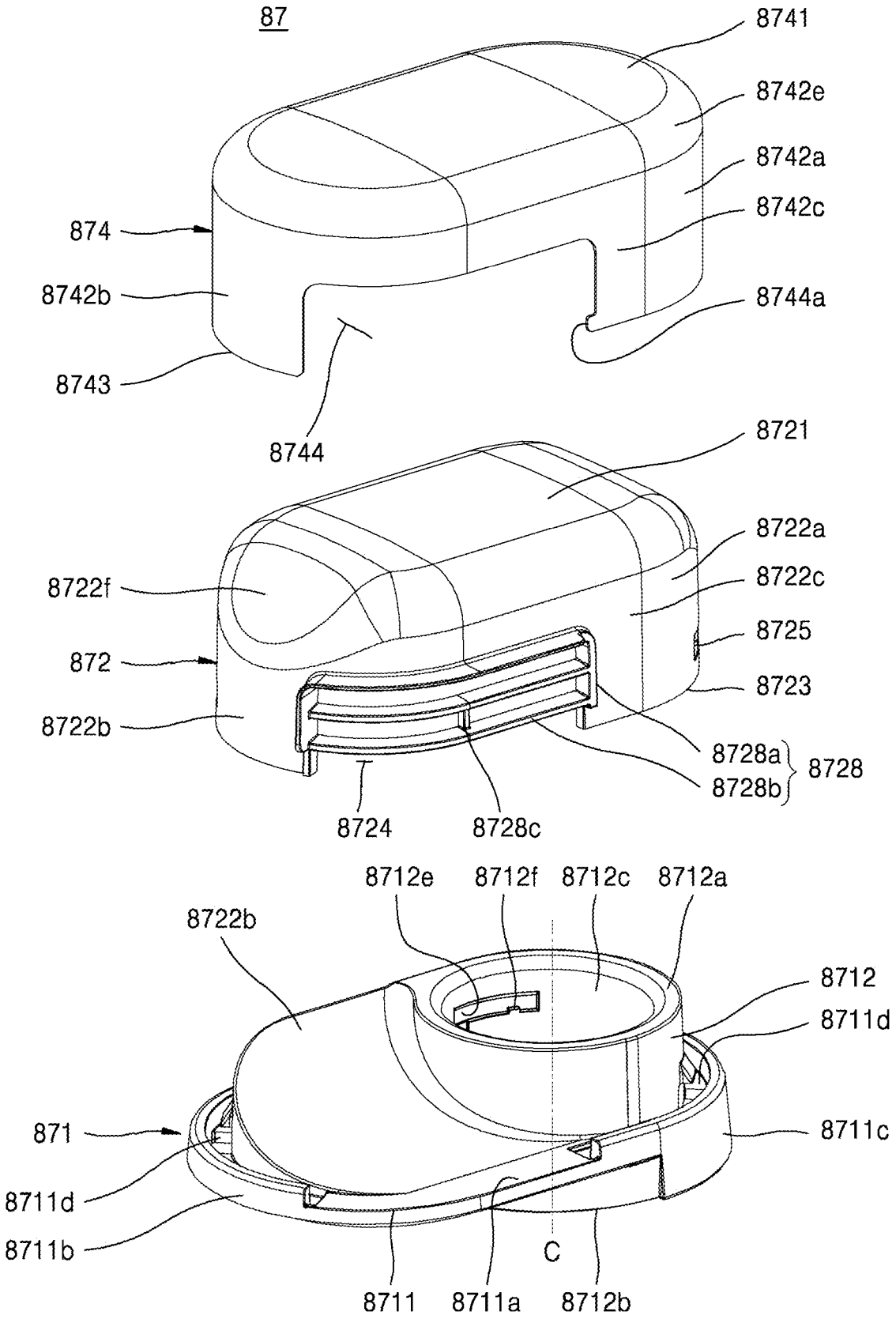
FIGS. 12 and 13 are exploded perspective views showing the airflow guide in FIG. 6.
Figure 13:
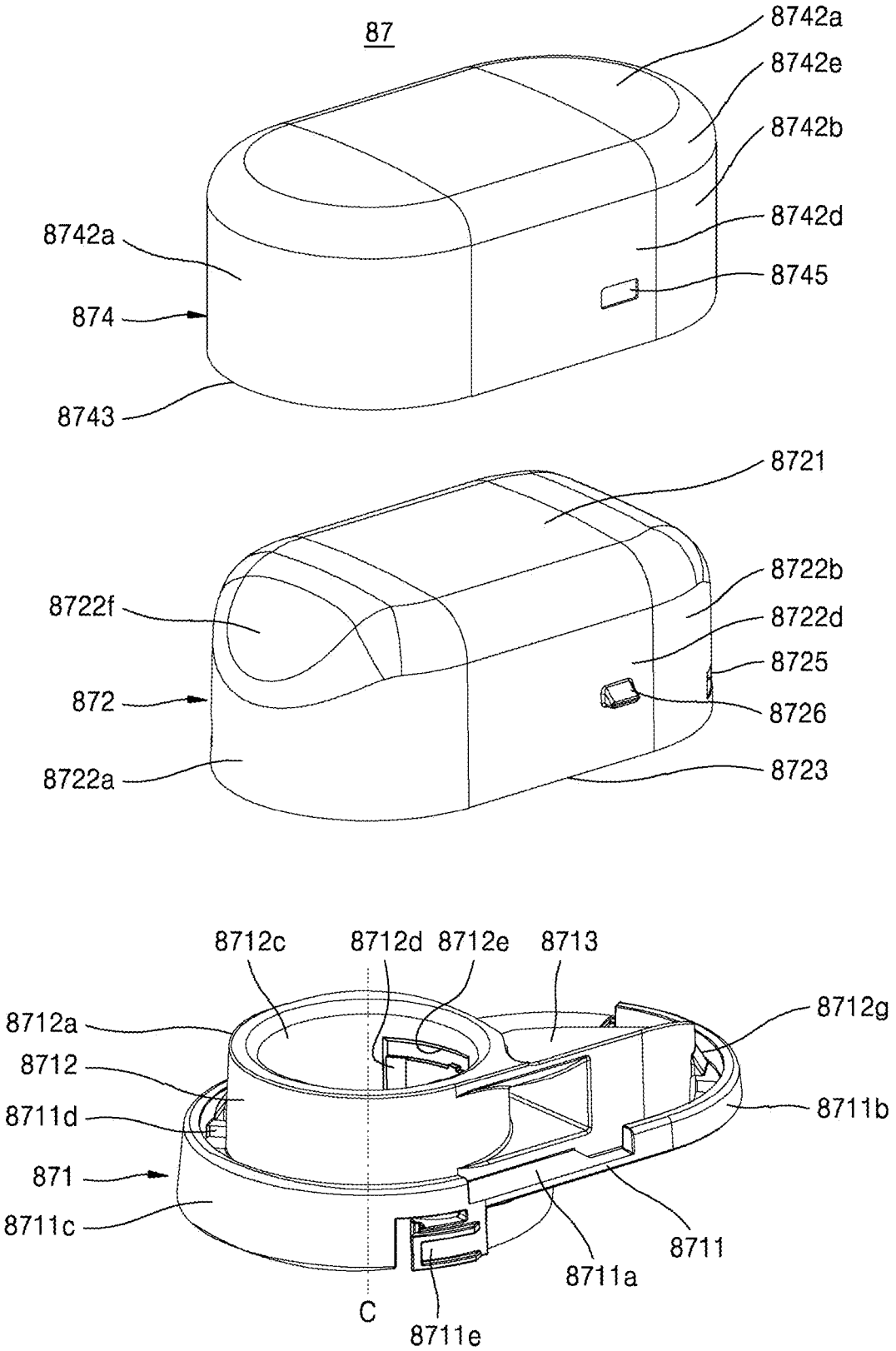

As illustrated in FIGS. 12 and 13, the airflow guide 87 of the dishwasher 1 of one embodiment may comprise a lower guide 871 detachably coupled to the duct main body 851 of the connection duct part 85, an upper guide 872 coupled to the upper side of the lower guide 871, and a cap cover 874 disposed at the upper side of the upper guide 872 and coupled to the outer surface of the upper guide 872.

The airflow guide 87, as illustrated, may be divided with respect to the up-down direction (U-D direction). The lower guide 871 constitutes the lower portion of the segment body. The upper guide 872 and the cap cover 874 may constitute the upper portion of the segment body.

The lower guide 871 may comprise a guide main body 8711 formed approximately into a plate.

The front-rear (F-R direction) width of the guide main body 8711 may be greater than the left-right (Le-Ri direction) width in the state where the guide main body 8711 is disposed at the connection duct part 85.

At this time, the left and right edges of the outer edge forming the outer shape of the guide main body 8711 may be formed into a straight line, and the front edge may be formed into a circular arc that is convex forward, while the rear edge may be formed into a circular arc that is convex rearward.

The left and right edges of the guide main body 8711 may be approximately parallel with each other and symmetrical to each other, and the front and rear edges of the guide main body 8711 may be symmetrical to each other.

A reference surface 8711*a* may be formed at the right edge side of the guide main body 8711 and serve as the lower end edge of the above-described discharge opening 873. The reference surface 8711*a*, as illustrated, may be formed into a flat surface and extend from the right edge to the lower end of a channel guide surface 8713 that is described below.

Additionally, a first edge wall 8711*b* may be formed at least partially at the left edge, the right edge, the front edge and the rear edge of the guide main body 8711 and extend from the reference surface 8711*a* in the upward direction (U-direction) to have a predetermined height.

The first edge wall 8711*b*, as illustrated, may be continuously formed along the outer edge of the guide main body 8711. However, the first edge wall 8711*b* may be formed incompletely not to prevent the spray of dry air at least in the discharge opening 873 area, as illustrated in FIG. 12.

Figure 14:
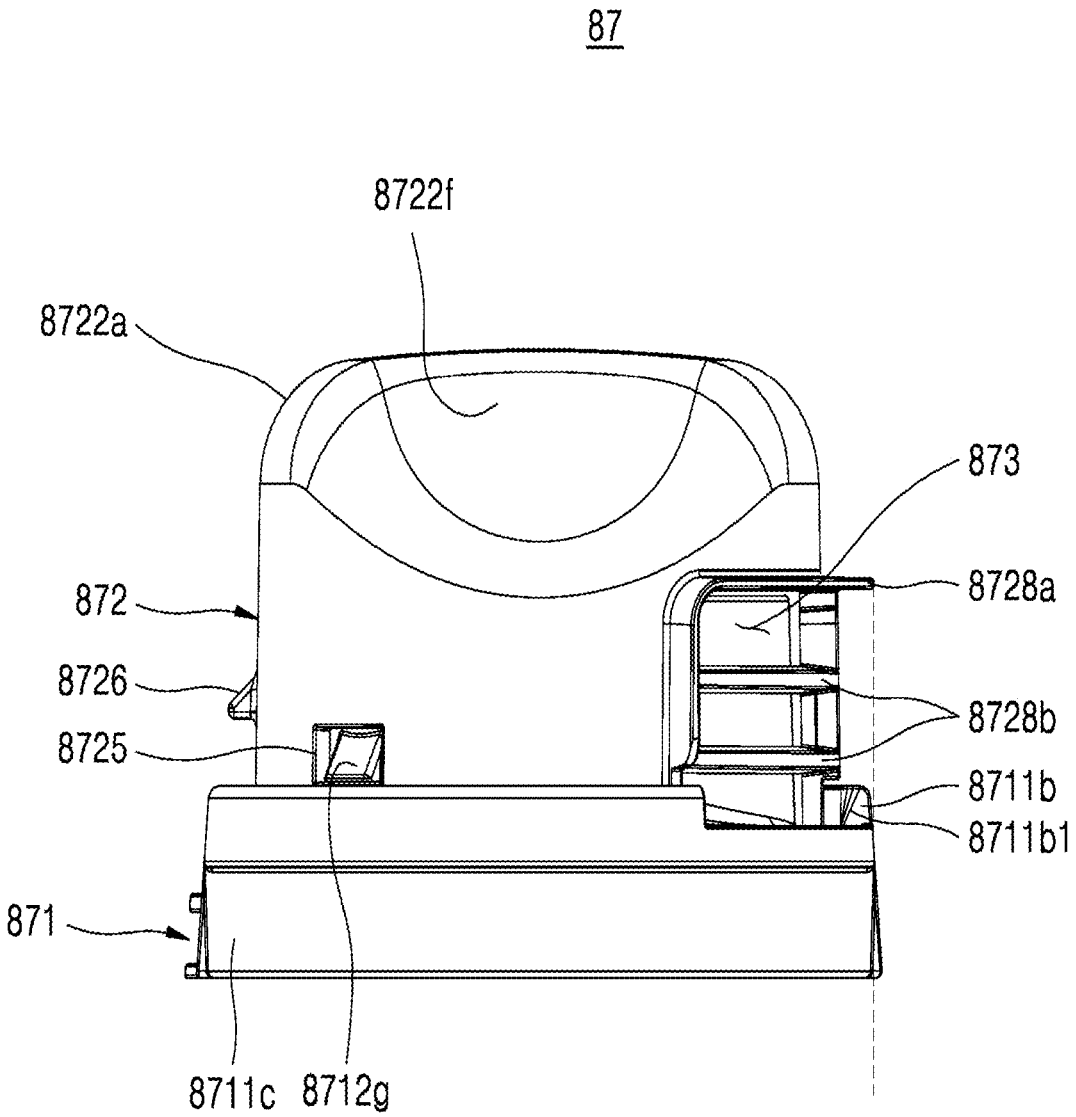
FIG. 14 is a front view showing the airflow guide in FIGS. 12 and 13.

As illustrated in FIG. 14, an inner circumferential surface 8711*b*1 of the first edge wall 8711*b* may be formed into an inclined surface that is widened gradually outward in the upward direction. The inner circumferential surface 8711*b*1 formed into an inclined surface may guide a lower end portion 8723 of the upper guide 872 effectively to a misassembly prevention groove 8711*d* that is described below such that the upper guide 872 and the lower guide 871 are coupled and assembled to each other readily.

Additionally, since the inner circumferential surface 8711*b*1 of the first edge wall 8711*b* is formed into an inclined surface, a gap between the outer surface of the cap cover 874 and the inner circumferential surface 8711*b*1 of the first edge wall 8711*b* may remain wide after the upper guide 872 and the cap cover 874 are coupled to the lower guide 871. Accordingly, wash water may be drained effectively out of the airflow guide 87 through the gap without remaining between the cap cover 874 and the lower guide 871.

Further, a misassembly prevention groove 8711*d* may be formed inside the first edge wall 8711*b* and be depressed further downward (in the D-direction) than the reference surface 8711*a*, with respect to the up-down direction (U-D direction), and serve as a misassembly prevention part of the upper guide 872. At this time, the height at which the misassembly prevention groove 8711*d* is depressed from the reference surface 8711*a*, may remain constant approximately along the first edge wall 8711*b*.

The lower end portion 8723 of the upper guide 872, which is described below, may be inserted and coupled to the misassembly prevention groove 8711*d*. Accordingly, the misassembly prevention groove 8711*d* may have a shape and a size corresponding to the shape and the size of the lower end portion 8723 of the upper guide 872. As described hereafter, the shape of the lower end portion 8723 of the upper guide 872 is formed continuously except for the area where a first notch hole 8724 forming the discharge opening 873 is formed, i.e., the area where the reference surface 8711*a* is formed. In response, the misassembly prevention groove 8711*d* may be formed continuously along the first edge wall 8711*b*.

At this time, the shape of the lower end portion 8723 of the upper guide 872 may be asymmetrical to the shape of the misassembly prevention groove 8711*d* in the front-rear direction (F-R direction). Accordingly, the lower end portion 8723 of the upper guide 872 may not be coupled and fastened to the misassembly prevention groove 8711*d* in a direction different from a predetermined direction. By doing so, a misassembly between the upper guide 872 and the lower guide 871 may be prevented effectively. The configurations of a coupling structure and a misassembly prevention structure between the upper guide 872 and the lower guide 871 are described below with reference to FIGS. 17 to 19.

Additionally, a second edge wall 8711*c* may be formed at the front edge of the guide main body 8711 and extend from the reference surface 8711*a* in the downward direction (D-direction) to have a predetermined height.

The second edge wall 8711*c*, as illustrated, may be formed continuously into a cylinder along the circular arc-shaped front edge of the guide main body 8711, and a lower end portion of the second edge wall 8711*c* may extend to a lower end 8712*b* of a duct coupling part 8712 that is described below.

That is, the second edge wall 8711*c* may be formed in a way that surrounds the outer surface of the below-described duct coupling part 8712 at least partially. At this time, the second edge wall 8711*c* is formed in the state of being separated and spaced from the duct coupling part 8712, and a predetermined space may be formed between the second edge wall 8711*c* and the duct coupling part 8712. As described below, an upper end 8522 of the fastening nut 852 may be inserted into the space.

A release prevention part 8711*e* may be provided on the second edge wall 8711*c*, and based on an interaction between the second edge wall 8711*c* and the fastening nut 852, keep the lower guide 871 fixed to the fastening nut 852 and prevent the lower guide 871 from escaping from the fastening nut 852.

As described hereafter, the lower guide 871 is detachably coupled to the duct main body 851 of the connection duct part 85 based on a two-stage coupling manipulation, without an additional coupling member. The two-stage coupling manipulation may comprise an up-down perpendicular movement manipulation and a circumferential rotational movement manipulation, for example.

The release prevention part 8711*e* prevents the relative rotation of the lower guide 871 in a direction opposite to the direction of the rotational movement in the two-stage coupling manipulation, i.e., prevents the lower guide 871 from escaping from the fixed position after the second-stage coupling manipulation including the perpendicular movement manipulation and the rotational movement manipulation is completed.

The release prevention part 8711*e*, as illustrated exemplarily, may be formed integrally to the second edge wall 8711*c*, and prevent the relative rotation of the lower guide 871 in a direction opposite to the direction of the rotational movement of the two-stage coupling manipulation, in the form of an elastic hook.

The fastening nut 852 may be provided with a plurality of stoppers 8521 that interact with the release prevention part 8711*e*. Detailed configurations of the release prevention part 8711*e*, and the plurality of stoppers 8521 of the fastening nut 852 are described below with reference to FIGS. 23 and 24.

The lower guide 871, as described above, is directly coupled to the duct main body 851 of the connection duct part 85, using a pipe coupling method.

To this end, the lower guide 871 may comprise a cylindrical duct coupling part 8712 to which the cylinder-shaped upper end portion 8511 of the duct main body 851 is inserted and detachably coupled.

In response to the shape of the duct main body 851, the duct coupling part 8712 may be formed into a cylinder the central axis C of which extends in parallel with the up-down direction (U-D direction). For the upper end portion 8511 of the duct main body 851 to be inserted into the duct coupling part 8712, the inner diameter of the lower end 8712*b* of the duct coupling part 8712 may be greater than or the same as the outer diameter of the upper end portion 8511 of the duct main body 851.

The duct coupling part 8712 may be formed integrally at the guide main body 8711, and disposed near the circular arc-shaped rear edge of the guide main body 8711. That is, the duct coupling part 8712 may be biased toward the rear side of the guide main body 8711 with respect to the front-rear direction (F-R direction).

An upper end 8712*a* of the cylindrical duct coupling part 8712, from which dry air is discharged, may protrude from the guide main body 8711, in the upward direction (U-direction). For example, the upper end 8712*a* of the duct coupling part 8712 protrudes to and is exposed to the inner flow space formed between the guide main body 8711 and the upper guide 872 of the lower guide 871.

As described hereafter, the position P2 of the upper end 8712*a* of the duct coupling part 8712, through which dry air passes, may be formed higher than the position P1 of the upper end edge of the first notch hole 8724 forming the discharge opening 873, with respect to the up-down direction (U-D direction).

Additionally, the central axis C of the duct coupling part 8712 may be disposed further frontward than the first notch hole 8724, with respect to the front-rear direction (F-R direction). By doing so, the entry of reversely incoming wash water, coming in from the discharge opening 873, into the duct coupling part 8712 through the upper end 8712*a* of the duct coupling part 8712 may be minimized.

A lower end 8712*b* of the cylindrical duct coupling part 8712 may protrude from the guide main body 8711 in the downward direction (D-direction). For example, the lower end 8712*b* of the duct coupling part 8712, into which the upper end portion 8511 of the duct main body 851 is inserted, may extend toward the lower surface 25 of the bottom tub 20*c*, and may be near or contact the lower surface 25 of the bottom tub 20*c* in the state where the airflow guide 87 is disposed at the connection duct part 85.

Additionally, a first guide groove 8712*d* and a second guide groove 8712*e* may be formed on an inner circumferential surface 8712*c* of the duct coupling part 8712, and the first guide groove 8712*d* may extend linearly along the up-down direction (U-D direction) while the second guide groove 8712*e* may extend in a circular arc shape along the circumferential direction.

As illustrated, the upper end of the first guide groove 8712*d* and one end portion of the second guide groove 8712*e* connect integrally.

The lower guide 871, as described above, is coupled to the duct main body 851 of the connection duct part 85, based on the two-stage coupling manipulation comprising the up-down perpendicular movement manipulation and the circumferential rotational movement manipulation.

The first guide groove 8712*d* extending linearly along the up-down direction (U-D direction) guides the up-down perpendicular movement of the lower guide 871, and the second guide groove 8712*e* extending in a circular arc shape along the circumferential direction guides the circumferential rotational movement of the lower guide 871.

A guide projection 8516 may be integrally provided on the outer circumferential surface of the duct main body 851 inserted and coupled to the duct coupling part 8712 of the lower guide 871, and protrude toward the inner circumferential surface of the connection duct part 85 and be inserted into the first guide groove 8712*d* and the second guide groove 8712*e* of the connection duct part 85.

Accordingly, at a time of coupling the lower guide 871 and the duct main body 851, the guide projection 8516 may be inserted into the first guide groove 8712*d*, as described hereafter.

Thus, in the state where the guide projection 8516 of the duct main body 851 is inserted into the first guide groove 8712*d*, the lower guide 871 may move perpendicularly in the downward direction (D-direction).

As the up-down perpendicular movement manipulation of the two-stage coupling manipulation starts, the first guide groove 8712*d* may move in the downward direction (D-direction) along the guide projection 8516 that stands still. As the guide projection 8516 reaches the upper end of the first guide groove 8712*d*, the lower guide 871 may not move in the downward direction (D-direction) any longer because of the guide projection 8516's action.

At this time, since the guide projection 8516 has reached one end portion of the second guide groove 8712*e*, the lower guide 871 may not move in the downward direction (D-direction), but may rotate in the circumferential direction in the two-stage coupling manipulation.

As the lower guide 871 rotates for the circumferential rotational movement manipulation of the two-stage coupling manipulation, the second guide groove 8712*e* moves along the guide projection 8516 that stands still. As the guide projection 8516 reaches the other end portion of the second guide groove 8712*e*, the lower guide 871 may not rotate any longer in the circumferential direction because of the guide projection 8516's action.

As the lower guide 871 may not rotate any longer, a coupling between the lower guide 871 and the duct main body 851 may be completed, and the arrangement of the lower guide 871 to a fixed position may be completed, such that the lower guide 871 and the duct main body 851 are coupled without an additional coupling member or an additional fastening member.

As illustrated in FIG. 12, stick-slip in relation to the movement of the guide projection 8516 is formed at the other end portion side of the second guide groove 8712*e*, and a stopper projection 8712*f* for stopping an opposite-direction relative rotation of the lower guide 871 may be integrally formed on the inner circumferential surface 8712*c* of the duct coupling part 8712 after the guide projection 8516 reaches the other end portion of the second guide groove 8712*e*.

Thus, as long as external force of greater than a specific degree is not applied, the guide projection 8516 may be prevented from escaping from the other end portion of the second guide groove 8712*e* by the stopper projection 8712*f*.

Additionally, at least one upper guide holding projection 8712*g* for mutually fastening the upper guide 872 and the lower guide 871, which are described hereafter, may be formed integrally on the outer circumferential surface of the duct coupling part 8712.

As described hereafter, the upper guide 872 is coupled to the upper side of the lower guide 871.

At least one upper guide holding projection 8712*g* may have a lap surface having a predetermined inclination angle with respect to the outer circumferential surface of the duct coupling part 8712, and a step surface formed approximately perpendicularly with respect to the outer circumferential surface of the duct coupling part 8712 such that a coupling based on the downward movement of the upper guide 872 may be performed readily but a separation based on the upward movement of the upper guide 872 may not be performed readily.

As described hereafter, the upper guide 872 may be formed near the lower end portion 8723 and provided with a first holding hole 8725 penetrating the inside and the outside of the upper guide 872.

The first holding hole 8725 may be formed into a rectangular penetration hole that has a width and a height at which the upper guide holding projection 8712*g* can be inserted into the first holding hole 8725 at a time of coupling the upper guide 872 and the lower guide 871.

Further, a channel guide surface 8713 may be formed at the front side of the duct coupling part 8712 and guide dry airflow F having passed through the upper end 8712*a* of the duct coupling part 8712 to the discharge opening 873.

As illustrated in FIG. 12, the upper end of the channel guide surface 8713 may have a height that is approximately the same as the height of the upper end 8712*a* of the duct coupling part 8712, and the lower end of the channel guide surface 8713 extends to the reference surface 8711*a*.

A curved surface or an inclined surface may be continuously formed between the upper end and the lower end of the channel guide surface 8713 to minimize the flow loss of dry airflow and the amount of generated flow noise.

At this time, the rear side of the channel guide surface 8713 may extend to contact the inner surface of a below-described second curved surface part 8722*b* constituting the rear surface of the upper guide 872, and be formed into a curved surface to have a shape corresponding to the shape of the rear surface of the upper guide 872.

The front side of the channel guide surface 8713 may extend to the outer circumferential surface of the duct coupling part 8712. For example, the front side of the channel guide surface 8713 may integrally connect to the outer circumferential surface of the duct coupling part 8712.

For the lower guide 871 to perform a plurality of functions, somewhat complex shapes are integrally formed. Considering the shapes, the lower guide 871 may be manufactured using the plastic injection molding method.

Additionally, the upper guide 872 is coupled to the upper side of the lower guide 871, and forms a closed inner flow space formed into a channel in which dry airflow F flows together with the lower guide 871.

To form the inner flow space as illustrated, the upper guide 872 may be formed into a container which has a vacant space therein, and the lower surface of which is open entirely.

The open lower surface of the upper guide 872 may be coupled with the guide main body 8711 of the lower guide 871 and be open entirely. By doing so, a closed inner flow space may be formed between the upper guide 872 and the lower guide 871.

At this time, in response to the shape of the guide main body 8711 of the lower guide 871, the outer shape of the upper guide 872 may have a front-rear width greater than a left-right width.

The upper guide 872 may be formed into a container that has an upper end surface 8721 formed approximately in parallel with the reference surface 8711*a* of the lower guide 871, and a lower surface being open through an outer wall surface which extends in the downward direction (D-direction) along the circumference of the upper end surface 8721.

At this time, the upper end surface 8721 and the outer wall surface may be integrally formed, and have a uniform thickness as a whole to ensure a maximum inner flow space, and for example, be manufactured using plastic injection molding.

The outer wall surface may comprise a first flat surface part 8722*c* that forms the right side surface of the outer wall surface and is formed into a flat plate, and a second flat surface part 8722*d* that forms the left side surface of the outer wall surface and is formed into a flat plate. The first flat surface part 8722*c* and the second flat surface part 8722*d* may have a symmetrical shape, and be formed into a perpendicular surface or an inclined surface having a slope where a gap between the first flat surface part 8722*c* and the second flat surface part 8722*d* decreases gradually in the upward direction (U-direction).

Additionally, a first curved surface part 8722*a* may be continuously formed at the front sides of the first flat surface part 8722*c* and the second flat surface part 8722*d*, and a second curved surface part 8722*b* may be continuously formed at the rear sides of the first flat surface part 8722*c* and the second flat surface part 8722*d*.

The first curved surface part 8722*a* may form the front surface of the upper guide 872, and for example, have an outer shape of a half cylindrical surface that is convex forward.

Like the first curved surface part 8722*a*, the second curved surface part 8722*b* may form the rear surface of the upper guide 872, and for example, have an outer shape of a half cylindrical surface that is convex rearward.

The first curved surface part 8722*a* and the second curved surface part 8722*b* may be disposed to have an approximately symmetrical shape.

Each of the first curved surface part 8722*a* and the second curved surface part 8722*b* may be integrally formed at the upper end surface 8721, the first flat surface part 8722*c* and the second flat surface part 8722*dc*, and form a continuous surface for the upper end surface 8721, the first flat surface part 8722*c* and the second flat surface part 8722*d*.

As illustrated, a first camper surface 8722*e* in a camper shape may be formed at an edge formed between the upper end surface 8721 and the outer wall surface. The first camper surface 8722*e* may help to minimize flow loss or noise caused by eddy currents that may be generated at an angular edge side of the inner flow space in which dry airflow flows.

The first camper surface 8722*e* may be a curved surface having a predetermined curvature, or an inclined surface having a predetermined slope.

Like the first camper surface 8722*e*, a second camper surface 8722*f* in a camper shape may be formed at an edge that is formed by the upper end surface 8721 and the first curved surface part 8722*a* which are met, and at an edge that is formed by the upper end surface 8721 and the second curved surface part 8722*b* which are met.

Like the first camper surface 8722*e*, the second camper surface 8722*f* may be a curved surface having a predetermined curvature, or an inclined surface having a predetermined slope.

However, the edge that is formed by the upper end surface 8721 and the first curved surface part 8722*a* which are met, and the edge that is formed by the upper end surface 8721 and the second curved surface part 8722*b* which are met have directionality that is approximately perpendicular to the direction of the flow of dry airflow F, as described hereafter.

Accordingly, more flow loss can be caused at the edge that is formed by the upper end surface 8721 and the first curved surface part 8722*a* which are met, and the edge that is formed by the upper end surface 8721 and the second curved surface part 8722*b* which are met than the edge that is formed by the upper end surface 8721 and the first flat surface part 8722*c* which are met, and the edge that is formed by the upper end surface 8721 and the second flat surface part 8722*d* which are met.

To minimize the flow loss caused by eddy currents, the second camper surface 8722*f* may have a camper dimension much greater than that of the first camper surface 8722*e*.

The lower end portion 8723 of the upper guide 872 formed around the open lower surface of the upper guide 872 may be formed continuously while its height remains approximately constant from the upper end surface 8721 with respect to the up-down direction (U-D direction) such that the lower end portion 8723 of the upper guide 872 may be inserted and coupled to the misassembly prevention groove 8711*d* of the lower guide 871.

However, as described above, the first notch hole 8724 forming the front edge, the rear edge and the upper end edge of the discharge opening 873 may be formed in the lower end portion 8723 of the upper guide 872.

The first notch hole 8724, as illustrated, may be formed into a notch where the first flat surface part 8722*c* and the second curved surface part 8722*b* of the upper guide 872 are partially cut.

The lower end of the first notch hole 8724 is entirely open, and as the upper guide 872 is coupled to the lower guide 871, the above-described reference surface 8711*a* of the lower guide 871 may be inserted into the open lower end of the first notch hole 8724, and the reference surface 8711*a* may block the lower end of the first notch hole 8724.

The upper edge of the first notch hole 8724 may extend approximately in parallel with the reference surface 8711*a* of the lower guide 871 and may extend linearly.

The rear edge of the first notch hole 8724 may be formed at the first flat surface part 8722*c* and extend linearly along the up-down direction (U-D direction). The front edge of the first notch hole 8724 may be formed at the second curved surface part 8722*b* and extend linearly along the up-down direction (U-D direction).

A rear corner part formed by the upper end edge and the rear edge which are met, and a front corner part formed by the upper end edge and the front edge which are met may respectively have a curved edge having a predetermined curvature.

The first holding hole 8725, which is formed into a rectangular penetration hole and to which the above-described upper guide holding projection 8712*g* of the lower guide 871 is held and coupled, may be formed at the first curved surface part 8722*a* of the upper guide 872, near the lower end portion 8723 of the upper guide 872.

As illustrated in FIG. 12, the outer shape of the upper guide 872, when viewed from above, is approximately symmetrical with respect to the front-rear direction (F-R direction), but the first notch hole 8724 and the first holding hole 8725 are formed in an asymmetrical position with respect to the front-rear direction (F-R direction). The first notch hole 8724 and the first holding hole 8725 may serve as a means of preventing the misassembly of the upper guide 872 to the lower guide 871, as described hereafter.

Additionally, at least one cap cover holding projection 8726 for fastening the cap cover 874 described hereafter may be integrally formed at the second flat surface part 8722*d* of the upper guide 872.

As described hereafter, the cap cover 874 may be coupled to the outer surface of the upper guide 872.

Like the above-described upper guide holding projection 8712*g*, at least one cap cover holding projection 8726 may have a lamp surface having a predetermined angle with respect to the second flat surface part 8722*d*, and a step surface formed approximately perpendicularly with respect to the second flat surface part, to ensure ease of coupling and prevent ease of separation.

To prevent the misassembly of the cap cover 874, the cap cover holding projection 8726 may be disposed higher than the above-described upper guide holding projection 8712*g* with respect to the up-down direction.

As described hereafter, the cap cover 874 may be provided with a second holding hole 8745 that is formed near the lower end portion 8743 in a way that penetrates the inside and the outside of the cap cover 874.

The second holding hole 8745 may be formed into a rectangular penetration hole having a width and a height at which the cap cover holding projection 8726 can be inserted into the second holding hole 8745 at a time of coupling the upper guide 872 and the cap cover 874, and like the cap cover holding projection 8726, may be disposed higher than the upper guide holding projection 8712*g* with respect to the up-down direction.

By doing so, the cap cover holding projection 8726 and the second holding hole 8745 may clearly distinguish from the upper guide holding projection 8712*g* because of the difference in their heights, and when view from above, the misassembly of the cap cover 874 having a symmetrical shape with respect to the front-rear direction (F-R direction) may be prevented effectively.

Additionally, the upper guide 872 of the airflow guide 87 of one embodiment may be provided with a blocking rib 8728 as a means of minimizing the reverse inflow of wash water into the airflow guide 87 through the discharge opening 873.

Figure 15:
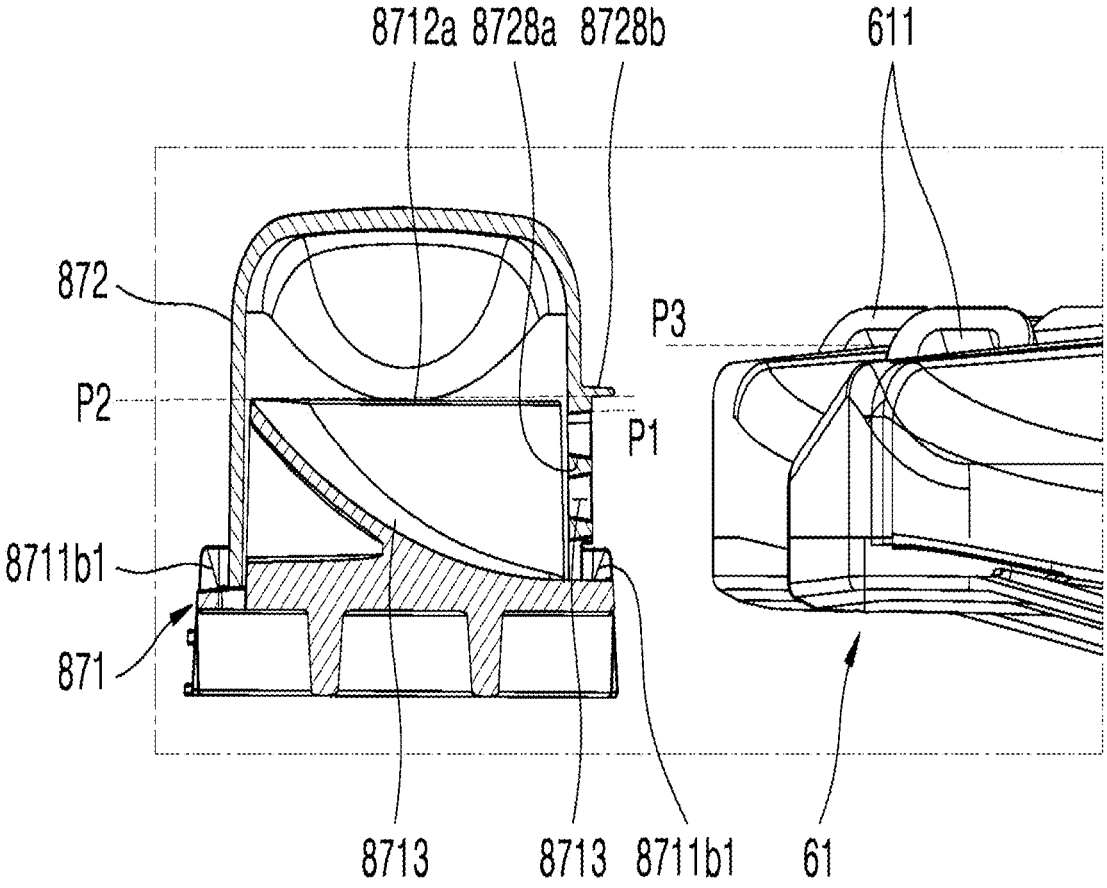
FIG. 15 is a cross-sectional view of FIG. 14 and a view for describing a position relative to a lower spray arm nozzle.

As illustrated in FIGS. 14 and 15, the blocking rib 8728 may comprise a first rib 8728*a* that extends in a shade shape along the upper end edge, the front edge and the rear edge of the first notch hole 8724.

The first rib 8728*a* extends continuously along the edges of the first notch hole 8724 and protrude approximately perpendicularly with respect to the outer wall surface of the upper guide 872. For example, the first rib 8728*a* may be formed integrally on the outer wall surface of the upper guide 872.

One end portion of the first rib 8728*a* may be formed at the rear edge of the first notch hole 8724, and the other end portion of the first rib 8728*a* may be formed at the front edge of the first notch hole 8724. The first rib 8728*a* may extend in a continuous protruding wall shape, between one end portion and the other end portion thereof, to serve as a shade surrounding the first notch hole 8724 approximately entirely.

However, to prevent interference with the first edge wall 8711*b* of the lower guide 871, one end portion and the other end portion of the first rib 8728*a* may be respectively spaced a predetermined height from the lower end portion 8723 of the upper guide 872 in the upward direction (U-direction).

The first rib 8728*a* may help to minimize the fall of wash targets from the storage part after a wash or the passage of wash water scattered after a fall through the first notch hole 8724.

To this end, a horizontal rib of the first rib 8728*a*, formed at least at the upper end edge of the first notch hole 8724, may protrude past the first edge wall 8711*b* of the lower guide 871 and the reference surface 8711*a*, as illustrated in FIG. 14.

That is, the horizontal portion of the first rib 8728*a* may extend to cover the first edge wall 8711*b* and the reference surface 8711*a* with respect to the up-down direction (U-D direction), and in the state where the airflow guide 87 is installed completely, the first edge wall 8711*b* and the reference surface 8711*a* are covered and by the first rib 8728*a* and is not be seen, when view from above.

Accordingly, the flow of wash water, which falls perpendicularly after wash targets are washed, collides with the first edge wall 8711*b* and then is scattered, into the first notch hole 8724 may be minimized.

However, wash water scattered in the washing stage or the rinsing stage may fall in a direction different from the perpendicular direction. That is, wash water avoiding the first rib 8728*a*, colliding with the first edge wall 8711*b* and being scattered is likely to flow into the first notch hole 8724.

To prevent this from happening, the blocking rib 8728 may further comprise a at least one second rib 8728*b* that extends across the inside the first notch hole 8724, along the front-rear direction (F-R direction).

FIGS. 12 to 14 exemplarily show an embodiment provided with a pair of second ribs 8728*b* that are spaced in the up-down direction (U-D direction). Hereafter, an embodiment provided with a pair of second ribs 8728*b*, as illustrated, is described for convenience, but not limited.

Each of the pair of second ribs 8728*b* may extend across the inside the first notch hole 8724 and have the same shape.

At this time, to prevent deterioration in the spray efficiency of dry air spraying, the up-down thickness of each of the second ribs 8728*b* may be much less than the front-rear length.

However, to cover the inside of the first notch hole 8724 entirely with respect to the front-rear direction (F-R direction), the rear end portion of each of the second ribs 8728*b* may connect to the rear edge of the first notch hole 8724, and the front end portion of the second rib 8728*b* may connect to the front edge of the first notch hole 8724.

The shape of the second rib 8728*b* may help to prevent the inflow of wash water, caused by the wash water's recollision with the second rib 8728*b*, even if the wash water collides with the first edge wall 8711*b* by avoiding the first rib 8728*a* and is scattered.

At this time, the shape of the cross section of each of the second ribs 8728*b* may remain constant from the front end portion to the rear end portion.

For example, the shape of the cross section of each of the second ribs 8728*b*, as illustrated in FIG. 15, have a decreasing up-down width from the inside of the upper guide 872 to the outside of the upper guide 872.

That is, a distance between the pair of second ribs 8728*b*, and a distance between the pair of second ribs 8728*b* and the upper end edge of the first notch hole 8724 may increase toward the outside of the upper guide 872. Accordingly, it is unlikely that a foreign substance such as food and the like that is left after the washing stage or the rinsing stage is fixed to the first notch hole 8724 or flows into the upper guide 872 through the first notch hole 8724.

Additionally, since the thickness of the pair of second ribs 8728*b* is much less than the front-rear length thereof, the second ribs have relatively low strength, and is likely to be damaged by small magnitude of external force. To prevent such damage, a bridge rib 8728*c* is disposed between the front end portion and the rear end portion of the second rib 8728*b* and connects the pair of second ribs 8728*b* mutually to reinforce the second ribs. In the illustrative embodiment, the bridge rib 8728*c* extends only between the pair of second ribs 8728*b*, but may further extend to the upper end edge of the first notch hole 8724.

Further, the cap cover 874 disposed at the upper side of the upper guide 872 may be coupled to the outer surface of the upper guide 872 to protect the upper guide 872.

The upper guide 872 is disposed lower than the storage part that accommodates wash targets, and the upper end surface 8721 and the outer wall surface are disposed in a way that the upper end surface 8721 and the outer wall surface are mostly exposed to the wash space 21 of the tub 20. However, as described above, the upper guide 872 is made of a plastic material having relatively low strength.

Accordingly, the upper guide 872 may be broken directly due to a collision with wash targets that may fall from the storage part between the washing stage and the rinsing stage or may fall while the user withdraws the storage part.

The cap cover 874 is coupled to the upper side of the outer surface of the upper guide 872 to prevent the damage to the upper guide 872, caused by a collision with wash targets.

To this end, the cap cover 874 may be made of a material having higher breaking strength and corrosion resistance than the upper guide 872, and for example, may be formed with a sheet of metal such as stainless steel and the like.

To be coupled to the outer surface of the upper guide 872, the cap cover 874 may have a shape corresponding to the shape of the outer surface of the upper guide 872.

Accordingly, like the upper guide 872, the cap cover 874 has a vacant space therein, and is formed into a container that is entirely open.

The upper guide 872 may be inserted and coupled through an open lower surface of the cap cover 874.

In response to the shape of the upper guide 872, the outer shape of the cap cover 874 may have a front-rear width greater than a left-right width.

Specifically, the cap cover 874 may comprise an upper end surface 8741 formed in parallel with the upper end surface 8721 of the upper guide 872, and an outer wall surface extending along the circumference of the upper end surface 8721 in the downward direction (D-direction).

Like the upper guide 872, the outer wall surface of the cap cover 874 may comprise a first flat surface part 8742*c* forming a right side surface and being formed into a flat plate, and a second flat surface part 8742*d* forming a left side surface and being formed into a flat plate.

The first flat surface part 8742*c* and the second flat surface part 8742*d* may have a symmetrical shape, and be formed into a perpendicular surface or an inclined surface having a slope where a gap between the first flat surface part 8742*c* and the second flat surface part 8742*d* decreases gradually in the upward direction (U-direction).

Additionally, a first curved surface part 8742*a* may be formed at the front sides of the first flat surface part 8742*c* and the second flat surface part 8742*d*, and a second curved surface part 8742*b* may be continuously formed at the rear sides of the first flat surface part 8742*c* and the second flat surface part 8742*d*.

The first curved surface part 8742*a* may form the front surface of the cap cover 874, and for example, have an outer shape of a half cylindrical surface that is convex forward in response to the shape of the first curved surface part 8722*a* of the upper guide 872.

The second curved surface part 8742*b* may form the rear surface of the cap cover 874, and for example, have an outer shape of a half cylindrical surface that is convex forward in response to the shape of the second curved surface part 8722*b* of the upper guide 872.

Each of the first curved surface part 8742*a* and the second curved surface part 8742*b* may be integrally formed on the upper end surface 8741, the first flat surface part 8742*c* and the second flat surface part 8742*d*, and form a continuous surface for the upper end surface 8741, the first flat surface part 8742*c* and the second flat surface part 8742*d*.

Additionally, in response to the upper guide 872, a camper surface 8742*e* in a camper shape may be formed at an edge formed between the upper end surface 8741 and the outer wall surface.

However, unlike the upper guide 872, the cap cover 874 is not provided with a component corresponding to the second camper surface 8722*f* of the upper guide 872.

The lower end portion 8743 of the outer wall surface of the cap cover 874 may extend to the lower end portion 8723 of the outer wall surface of the upper guide 872 to cover the outer wall surface of the upper guide 872 entirely. Accordingly, at a time of coupling the cap cover 874 to the lower guide 871, the lower end portion 8743 of the cap cover 874 and the lower end portion 8723 of the upper guide 872 may be inserted into the misassembly prevention groove 8711*d* of the lower guide 871, together.

Additionally, a second notch hole 8744 may be formed in the lower end portion 8743 of the cap cover 874 and have a shape corresponding to that of the first notch hole 8724 of the upper guide 872.

Like the first notch hole 8724, the second notch hole 8744 may be formed into a notch where the first flat surface part 8742*c* and the second curved surface part 8742*b* of the cap cover 874 are partially cut.

Since the second notch hole 8744 has the same shape as the first notch hole 8724, a detailed shape of the second notch hole 8744 is not described.

However, a holding jaw 8744*a* may be provided at the lower end of the front edge of the second notch hole 8744 and protrude to the inside of the second notch hole 8744.

The holding jaw 8744*a* is a portion that is held and coupled to the other end portion of the above-described first rib 8728*a*, and the right side portion of the cap cover 874 may be coupled to the upper guide 872 through the holding jaw 8744*a*.

Additionally, the second holding hole 8745 may be formed near the lower end portion 8723 of the upper guide 872, at the second flat surface part 8742*d* of the cap cover 874, and formed into a rectangular penetration hole to which the above-described cap cover holding projection 8726 of the upper guide 872 is held and coupled.

As the cap cover holding projection 8726 is held and coupled to the second holding hole 8745, the left side portion of the cap cover 874 may be coupled to the upper guide 872.

That is, the cap cover 874 may be coupled to two spots of the upper guide 872 at least though the holding jaw 8744*a* and the cap cover holding projection 8726.

Hereafter, a means of preventing the reverse inflow of wash water in the airflow guide 87 of one embodiment is described with reference to FIGS. 15 and 16.

As described above, the airflow guide 87's discharge opening 873 spraying dry air to the wash space 21 of the tub 20 remains open inside the wash space 21.

Additionally, since the dry air supply part 80 is in a non-operation state in the washing stage or the rinsing stage, it is highly likely that wash water reversely flows into the inner flow space of the airflow guide 87 through the discharge opening 873. The reversely incoming wash water may also flow into the dry air supply part 80 by passing through the duct coupling part 8712 provided in the inner flow space of the airflow guide 87.

To prevent the reverse inflow of wash water, the airflow guide 87 of one embodiment is provided with a means of preventing the reverse inflow of wash water as follows.

The position P2 of the upper end 8712*a* of the duct coupling part 8712 which is exposed to the inner flow space and through which dry air passes may be higher than the position P1 of the upper end edge of the first notch hole 8724 forming the discharge opening 873, with respect to the up-down direction (U-D direction).

Accordingly, even if wash water enters into the inner flow space by passing through the discharge opening 873, the wash water is less likely to reach the upper end 8712*a* of the duct coupling part 8712 that is formed higher than the upper end edge of the first notch hole 8724 in the gravitational direction.

Figure 16:
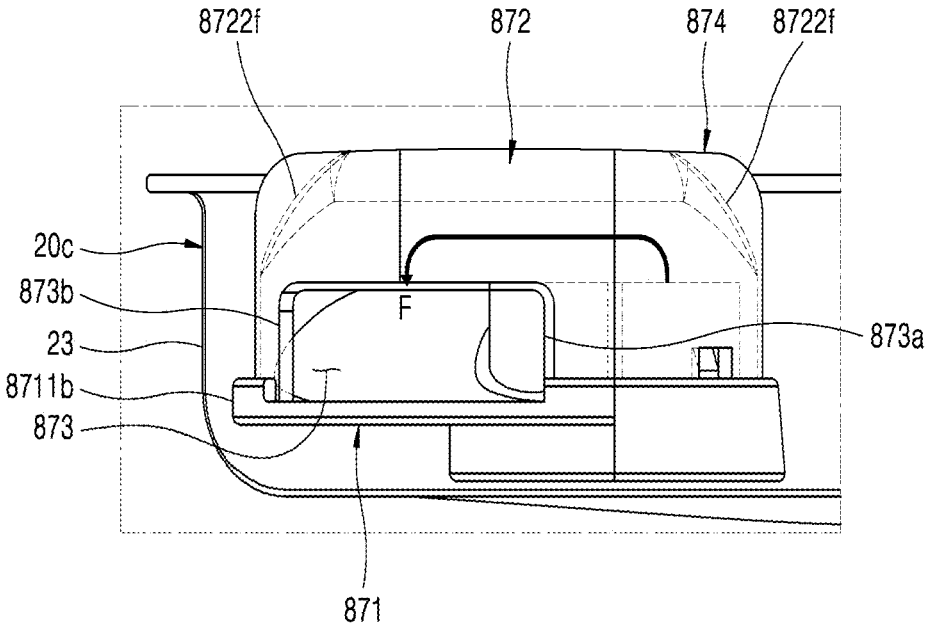
FIG. 16 is a side view showing an airflow guide fixed to a connection duct part.

Additionally, the central axis C of the duct coupling part 8712 may be disposed further forward than the first notch hole 8724 with respect to the front-rear direction (F-R direction), as illustrated in FIG. 16.

That is, at least the front edge of the first notch hole 8724 is disposed further rearward than the central axis C of the duct coupling part 8712. Accordingly, a portion of the upper end 8712*a* of the duct coupling part 8712, exposed to the outside through the discharge opening 873 or the first notch hole 8724, may be minimized, and the flow of the reversely incoming wash water, having passed through the discharge opening 873, into the duct coupling part 8712 through the upper end 8712*a* of the duct coupling part 8712 may be minimized.

Further, a channel guide surface 8713 may be provided in the inner flow space of the airflow guide 87, and have an upper end that extends to approximately the same height as the upper end 8712*a* of the duct coupling part 8712 and a lower end that extends in a curved surface shape or an inclined surface shape to the reference surface 8711*a* of the lower guide 871.

The configuration of the channel guide surface 8713 allows reversely incoming wash water, having passed through the discharge opening 873 or the first notch hole 8724, to be discharged to the bottom tub 20*c* through the discharge opening 873 or the first notch hole 8724 by gravity, while preventing the reversely flowing wash water from staying in the airflow guide 87 or moving toward the upper end 8712*a* of the duct coupling part 8712.

Further, a first rib 8728*a* extending in a shade shape may be provided at the upper end edge, the front edge and the rear edge of the first notch hole 8724, and at least one second rib 8728*b* extending across the first notch hole 8724 along the front-rear direction (F-R direction) may be provided in the first notch hole 8724.

By doing so, the amount of reversely incoming wash water, which comes in by passing through the discharge opening 873 or the first notch hole 8724 directly, may be minimized.

Further, as illustrated in FIG. 15, the position P1 of the upper end edge of the discharge opening 873 or the first notch hole 8724 may be lower than the position P3 of the plurality of nozzles 611 provided on the upper surface of the lower spray arm 61, with respect to the up-down direction (U-D direction).

The plurality of nozzles 611 provided at the lower spray arm 61 is provided to spray wash water in the upward direction (U-direction) to the lower rack 51 disposed at the upper side of the lower spray arm 61.

Accordingly, the discharge opening 873 or the first notch hole 8724 is disposed lower than the plurality of nozzles 611, and wash water sprays directly to the discharge opening 873 or the first notch hole 8724 through the plurality of nozzles 611, such that the wash water is less likely to come in reversely.

Hereafter, the misassembly prevention part between the lower guide 871 and the upper guide 872 of the airflow guide 87 of one embodiment is described with reference to FIGS. 17 to 19.

Figure 17:
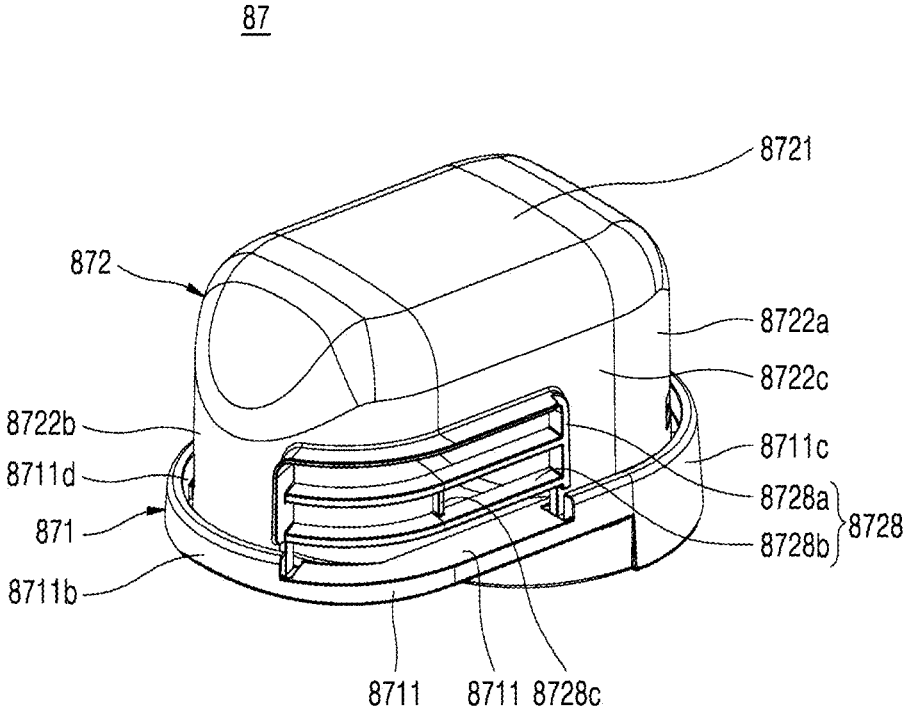
FIGS. 17 and 18 are perspective views showing an airflow guide assembled at the right position.
Figure 18:
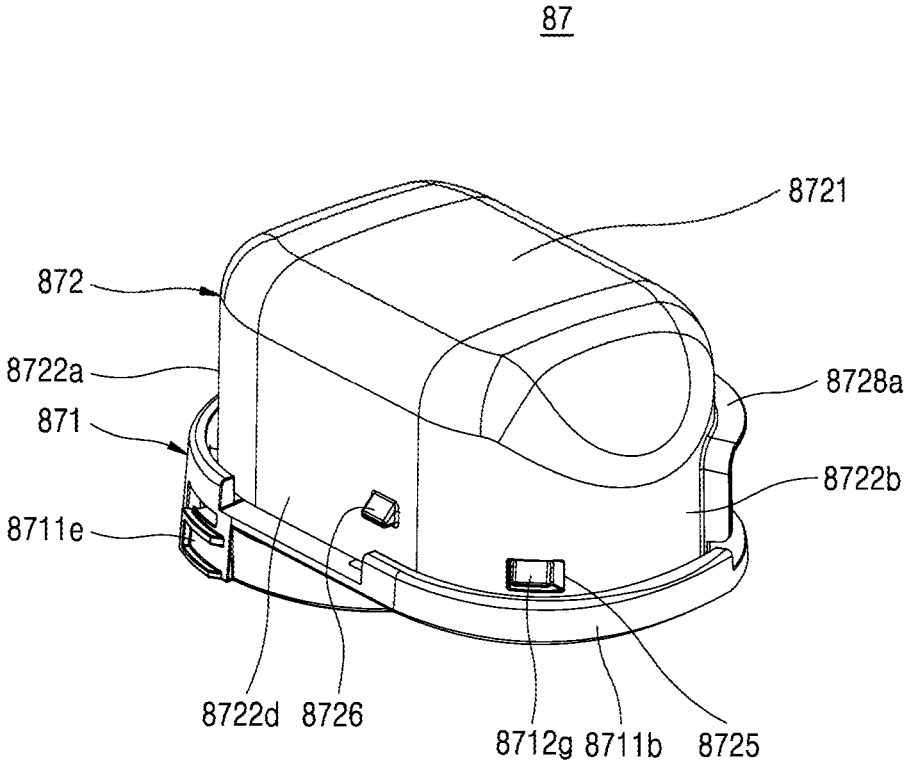

FIGS. 17 and 18 shows that the upper guide 872 is assembled to the lower guide 871, in a predetermined right position, and that the cap cover 874 is omitted for convenience.

As described above, the upper guide 872 and the lower guide 871 have outer shapes where the left and the right are symmetrical with respect to the front-rear direction (F-R direction), when viewed from above. But for an additional misassembly prevention part, the upper guide 872 can be coupled to the guide main body 8711 of the lower guide 871 in the state where the front and the rear of the upper guide 872 are reversed.

To prevent the misassembly in the state where the front and the rear are reversed, the shape of the lower end portion of the upper guide 872, and the shape of the misassembly prevention groove 8711*d* formed at the guide main body 8711 of the lower guide 871 that is coupled to the upper guide 872 may be asymmetrical with respect to the front-rear direction (F-R direction).

As described above, the asymmetrical shape of the lower end portion of the upper guide 872 may be embodied by the position where the first notch hole 8724 is formed and the shape of the first notch hole 8724, and the asymmetrical shape of the misassembly prevention groove 8711*d* of the lower guide 871 may be embodied by the reference surface 8711*a* formed at the guide main body 8711 and provided with no misassembly prevention groove 8711*d*.

Further, the upper guide holding projection 8712*g* and the first holding hole 8725 that fix the upper guide 872 to the lower guide 871 may be disposed asymmetrically in the front-rear direction (F-R direction).

As illustrated in FIGS. 17 and 18, in the state where the upper guide 872 and the lower guide 871 are arranged in a predetermined right position, as the upper guide 872 moves toward the lower guide 871 in the downward direction (D-direction) to be coupled to the lower guide 871, the lower end portion of the upper guide 872 may enter into the misassembly prevention groove 8711*d* having a space corresponding to the shape of the lower end portion of the upper guide 872.

Likewise, the first holding hole 8725 of the upper guide 872 may be inserted into, and held and coupled to the upper guide holding projection 8712*g* corresponding to the first holding hole 8725. By doing so, the upper guide 872 may be fixed to the lower guide 871, in the state of arranged in a predetermined right position.

Figure 19:
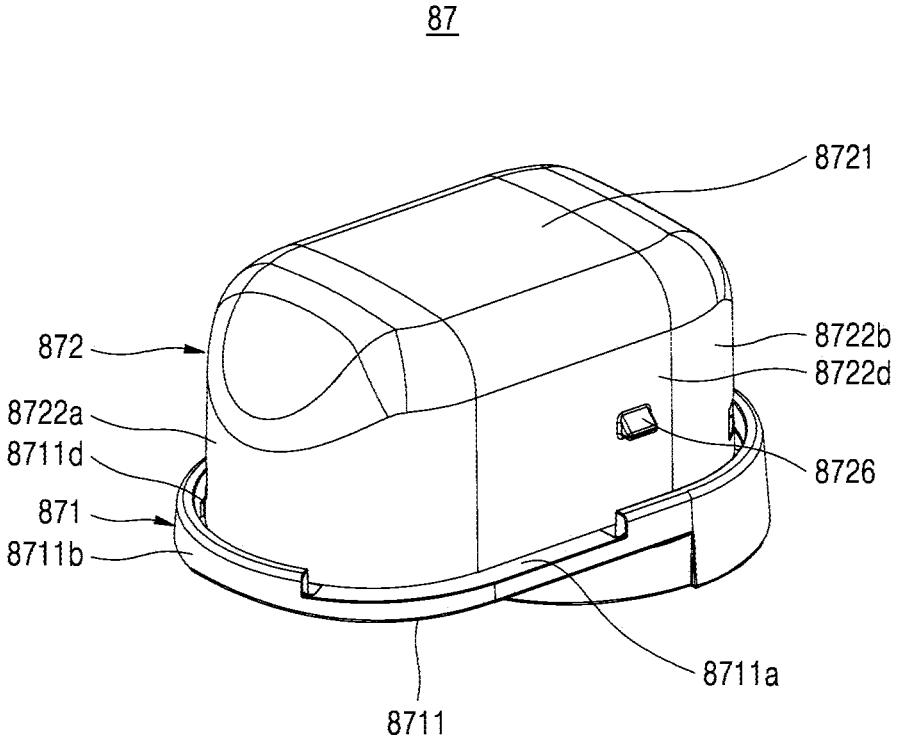
FIG. 19 is a perspective view showing an airflow guide misassembled.

However, when the upper guide 872 is coupled to the lower guide 871 in the state where the front surface and the rear surface of the upper guide 872 are reversed as illustrated in FIG. 19. The lower end portion 8723 of the upper guide 872 and the misassembly prevention groove 8711*d* are arranged incorrectly by 180 degrees with respect to the predetermined right position.

Accordingly, the lower end portion 8723 of the upper guide 872 is held by the reference surface 8711*a* that is formed higher than the misassembly prevention groove 8711*d* in the up-down direction (U-D direction), and may not enter or be inserted into the misassembly prevention groove 8711*d*.

Additionally, since the first holding hole 8725 of the upper guide 872 is arranged in a position that is rotated by 180 degrees with respect to the upper guide holding projection 8712*g*, the first holding hole 8725 may not be coupled to the upper guide holding projection 8712*g*. Accordingly, since the upper guide 872 may not be fixed to the lower guide 871, it may be intuitively found that the upper guide 872 is not arranged in the predetermined right position in the assembly process. By doing so, the misassembly between the upper guide 872 and the lower guide 871 may be prevented effectively.

Hereafter, the process of assembling and fixing the airflow guide 87 of one embodiment to the connection duct part 85 is described with reference to FIGS. 20A to 22C.

As described above, the lower guide 871 may be coupled to the duct main body 851 of the connection duct part 85 based on the two-stage coupling manipulation. For example, the two-stage coupling manipulation may comprise an up-down simple perpendicular movement manipulation and a circumferential simple rotational movement manipulation.

Figure 20A:
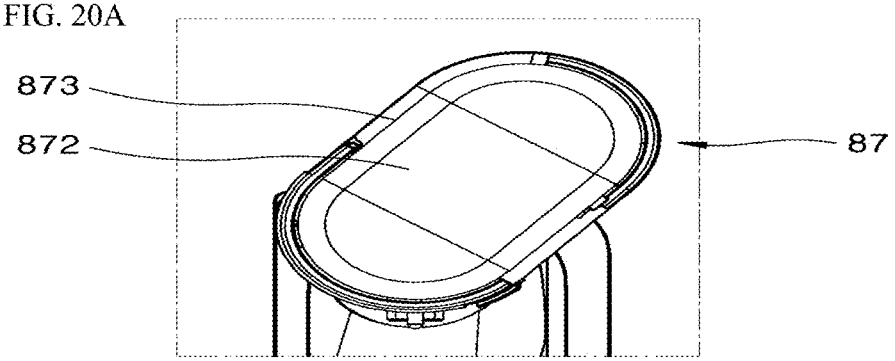
FIGS. 20A to 22C are plan views, front views and cross-sectional views for describing a process of assembling an airflow guide to a connection duct part.
Figure 20B:
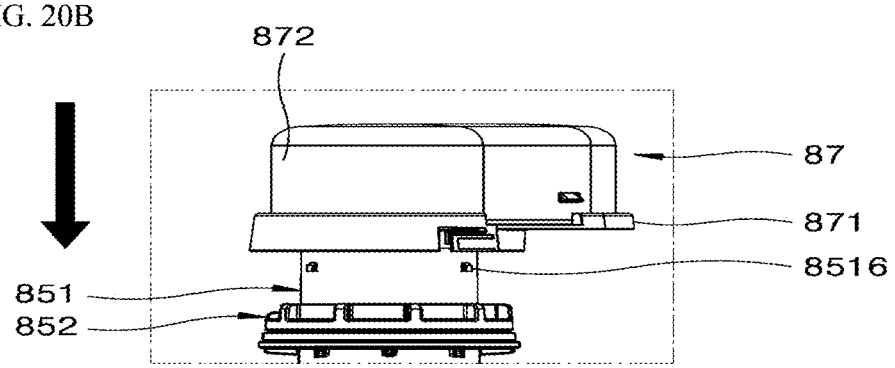
Figure 20C:
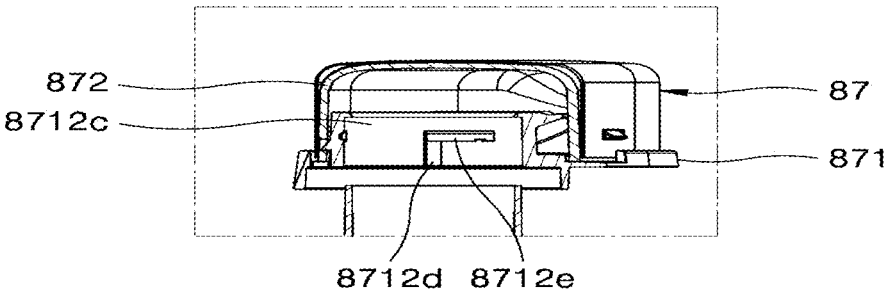

For the up-down perpendicular movement manipulation, in the state where the cap cover 874 and the upper guide 872 are coupled to the lower guide 871, the airflow guide 87 may be arranged to be disposed at the upper side of the duct main body 851 of the connection duct part 85, as illustrated in FIGS. 20A to 20C.

At this time, the central axes of the duct main body 851 and the duct coupling part 8712 may be arranged in the up-down direction (U-D direction) such that the upper end portion 8511 of the duct main body 851 may be inserted into the lower end 8712*b* of the duct coupling part 8712 of the lower guide 871.

Additionally, the airflow guide 87 may be rotated around the duct coupling part 8712 within a predetermined range of angles from the fixed position. The position of the airflow guide 87 rotated is a position in which the guide projection 8516 formed on the outer circumferential surface of the duct main body 851 can be inserted into the first guide groove 8712*d* of the duct coupling part 8712.

FIG. 20A shows that the airflow guide 87 is rotated clockwise in the drawing within a predetermined range of angles but is provided as an example. The coupling may start in the state where the airflow guide 87 is rotated counterclockwise. For example, the coupling that starts in the state where the airflow guide 87 is rotated clockwise as shown in the embodiment is described but not limited.

When the arrangement of the airflow guide 87 is completed with respect to the duct main body 851 as illustrated, the airflow guide 87 moves perpendicularly in the downward direction (D-direction) along the direction indicated by the arrow in FIG. 20B such that the upper end portion 8511 of the duct main body 851 is inserted into the lower end 8712*b* of the duct coupling part 8712. Accordingly, the guide projection of the duct main body 851 may be inserted into the lower end portion of the first guide groove 8712*d*.

In the state where the guide projection of the duct main body 851 is inserted into the lower end portion of the first guide groove 8712*d* as described above, as the airflow guide 87 perpendicularly moves in the downward direction (D-direction), the up-down perpendicular movement manipulation of the airflow guide 87 starts.

Accordingly, the movement of the first guide groove 8712*d* of the duct coupling part 8712 is guided by the guide projection that stands still, and the first guide groove 8712*d* perpendicularly moves in the downward direction (D-direction).

Figure 21A:
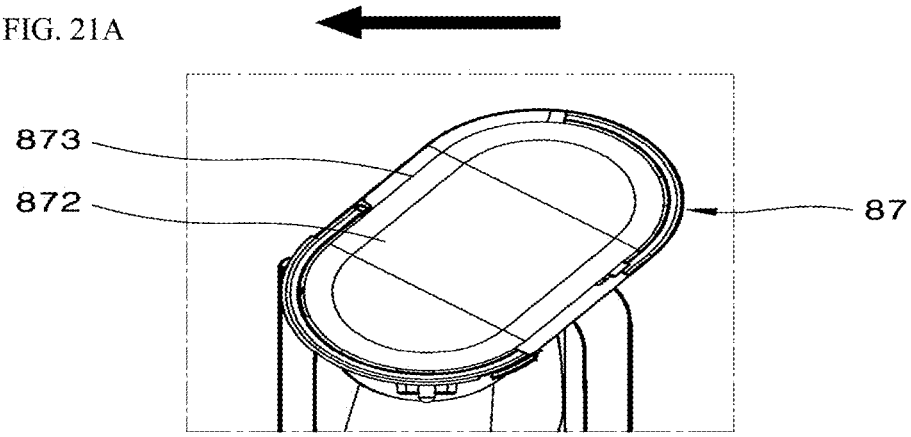
Figure 21B:
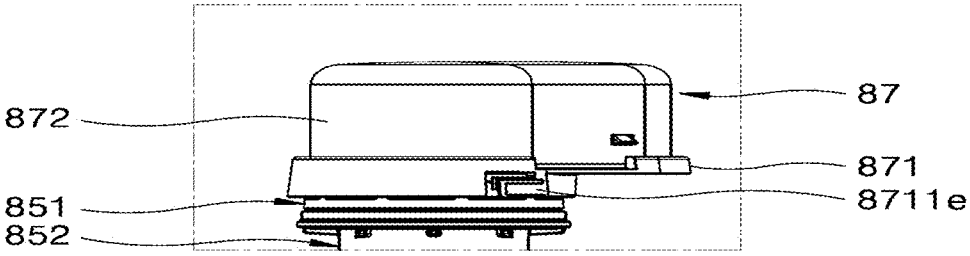
Figure 21C:
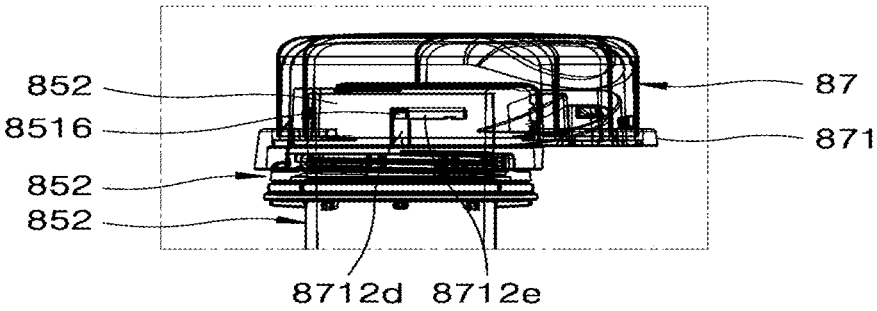
Figure 22A:
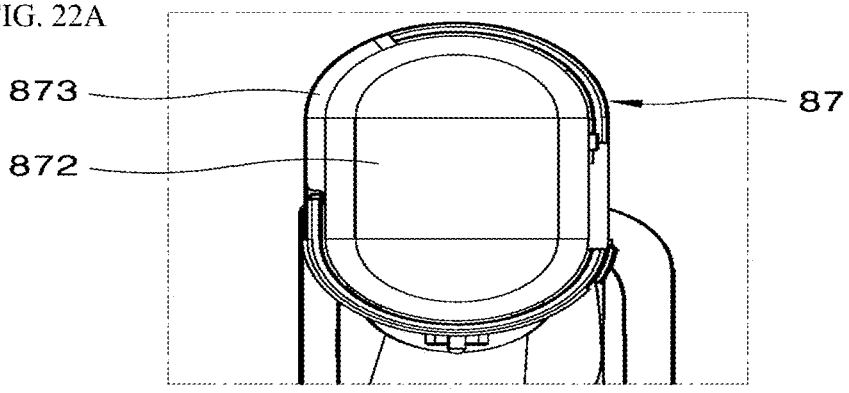
Figure 22B:
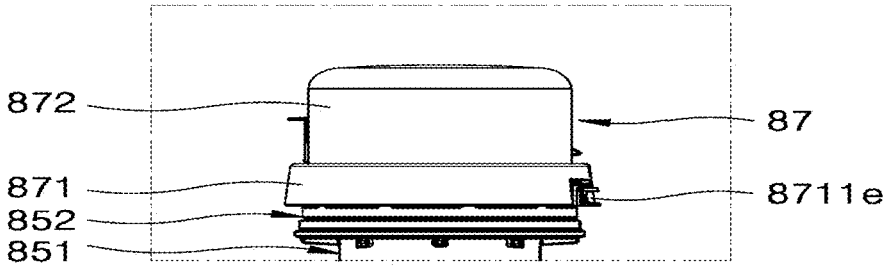
Figure 22C:
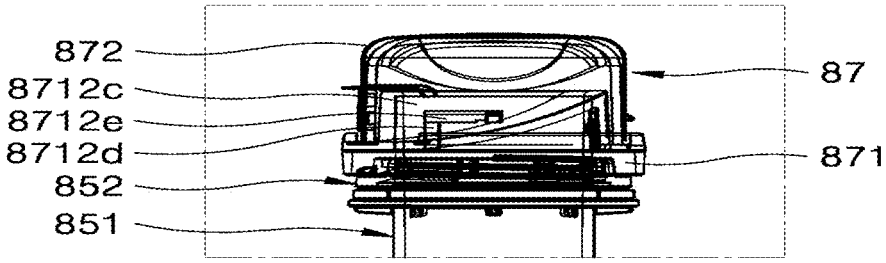

As the guide projection reaches the upper end of the first guide groove 8712*d* as illustrated in FIGS. 21A to 21C, the airflow guide 87 may not perpendicularly move in the downward direction (D-direction) any longer, based on the guide projection's action.

At this time, since the guide projection reaches one end portion of the second guide groove 8712*e*, the airflow guide 87 may not make a perpendicular movement in the downward direction (D-direction), but may make a rotational movement circumferentially along the direction indicated by the arrow in FIG. 21A.

For the circumferential rotational movement manipulation of the two-stage coupling manipulation, as the airflow guide 87 rotates counterclockwise along the direction indicated by the arrow, the second guide groove 8712*e* may start to make a rotational movement counterclock wise along the guide projection that sands still.

As the airflow guide 87 starts to make a rotational movement counterclockwise, the guide projection reaches the stopper projection 8712*f* that is disposed near the other end portion of the second guide groove 8712*e*.

At this time, stick-slip in relation to the rotation of the airflow guide 87 may be formed by the stopper projection 8712*f*, and as a rotational force is additionally applied, the guide projection may go over the stopper projection 8712*f*.

Then as the guide projection reaches the other end portion of the second guide groove 8712*e* past the stopper projection 8712*f*, the airflow guide 87 may not rotate counterclock wise any longer because of the guide projections' action.

When the airflow guide 87 cannot rotate any longer as described above, the coupling between the lower guide 871 and the duct main body 851 may be completed, and as long as another external force is not applied, the guide projection may be fixed to the other end portion side of the second guide groove 8712*e* by the stopper projection 8712*f*.

Accordingly, the airflow guide 87 may be disposed in a fixed position of the connection duct part 85, based on a very simple manipulation or assembly process comprising the simple perpendicular movement manipulation and the simple rotational movement manipulation.

However, the circumferential rotational movement of the lower guide 871 of the airflow guide 87 may be kept limited by the stopper projection 8712*f*, but the fixed state of the lower guide 871 may be undone by quite a small magnitude of external force.

That is, in the illustrative embodiment, the clockwise rotation of the airflow guide 87 fixed at a fixed position, which causes the undoing of the fixed state simply based on the interaction between the guide projection and the stopper projection 8712*f*, is limited.

Accordingly, even if quite a small magnitude of external force is applied at the rear side of the airflow guide 87 horizontally far from the central axis C of the duct coupling part 8712 of the lower guide 871, as the center of rotation, significantly high torque must occur to the stopper projection 8712*f* adjacent to the central axis C of the duct coupling part 8712.

Even if such external force is applied, the airflow guide 87 of the dishwasher of one embodiment may be provided with a release prevention part 8711*e* for preventing the airflow guide 87 from escaping from the fixed position and keeping the airflow guide 87 fixed to the fixed position.

The release prevention part 8711*e*, as described above, may be integrally formed on the second edge wall 8711*c* of the lower guide 871 in a way that a L-shaped notch is formed at the lower end side of the second edge wall 8711*c* of the lower guide 871, i.e., in a way that the lower end of the second edge wall 8711*c* is partially cut.

For example, the release prevention part 8711*e* may be disposed near the left edge side of the guide main body 8711 of the lower guide 871, on the second edge wall 8711*c*.

Figure 23:
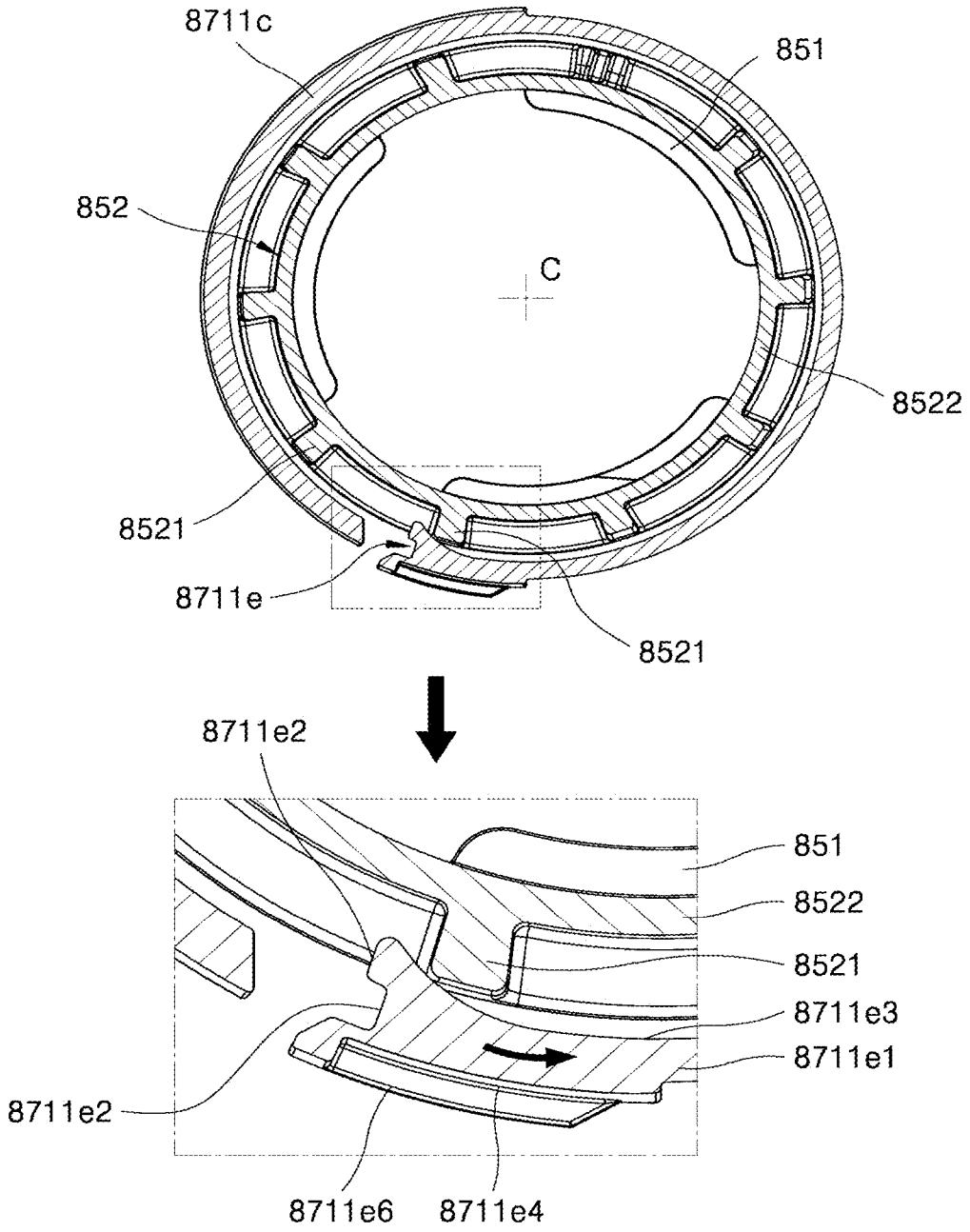
FIGS. 23 and 24 are cross-sectional views for describing the structure and the function of a release prevention part provided at an airflow guide.
Figure 24:
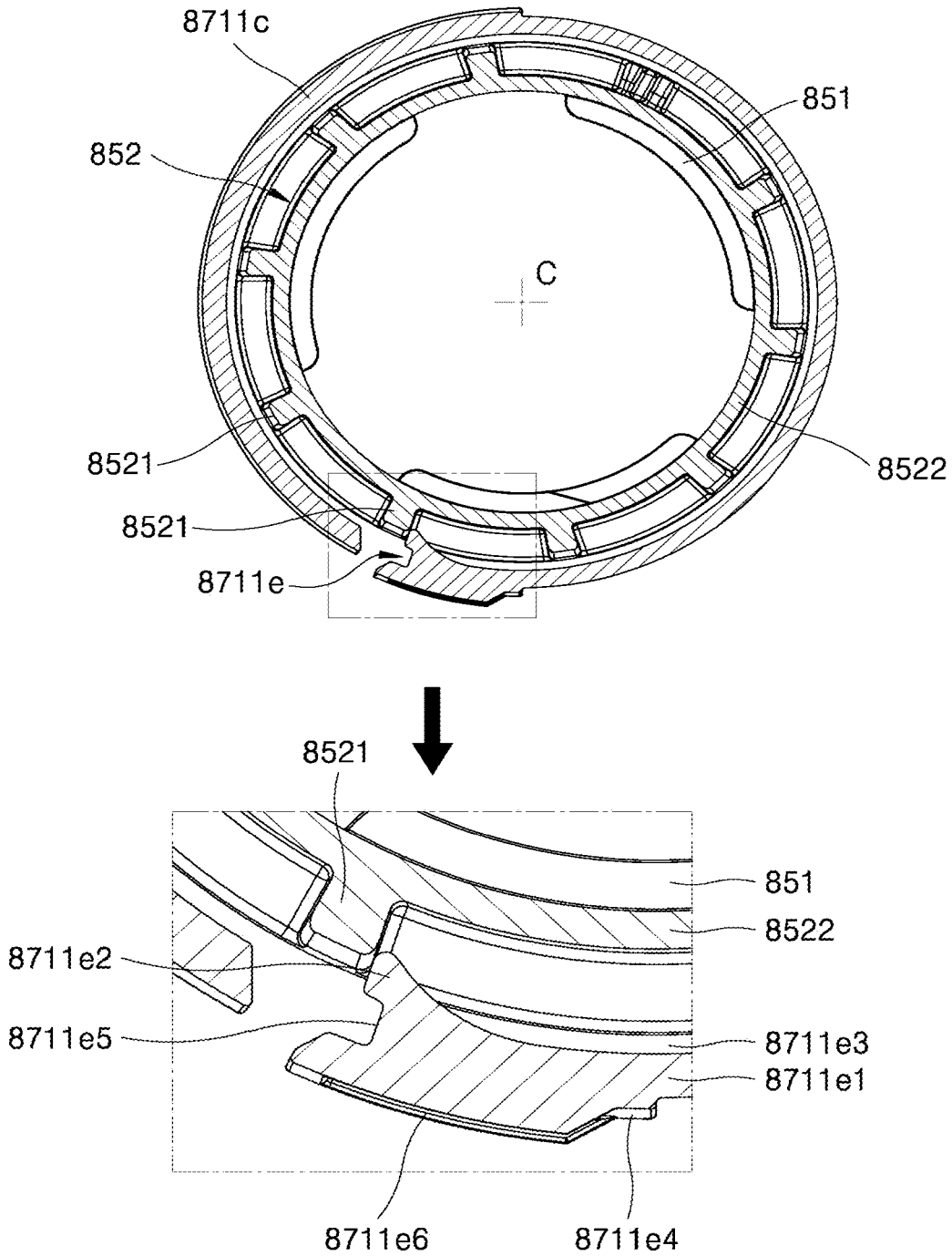

Specifically, the release prevention part 8711*e* may be formed into a circular arc-shaped plate that is disposed in a way that surrounds the circumference of the fastening nut 852 disposed inside the second edge wall 8711*c*, in a circular arc shape, and is elastically deformable, as illustrated in FIGS. 23 and 24.

One end portion of the release prevention part 8711*e* functions as a fixation end portion 8711*e*1 integrally connecting to the second edge wall 8711*c*. As described hereafter, the fixation end portion 8711*e*1 may also provide resilient force or elastic force to the other end portion side that is deformed at a time of rotational movement manipulation for installing and fixing the airflow guide 87.

The other end portion of the release prevention part 8711*e* separates from the second edge wall 8711*c* and functions as a free end portion 8711*e*2, and directly contacts one lateral surface of the stopper 8521 provided in the upper portion of the fastening nut 852 to stop the rotation of the lower guide 871.

To keep the free end portion 8711*e*2 contacting and holding the stopper 8521 directly and effectively, the radial thickness of the free end portion 8711*e*2 may be greater than the radial thickness of the fixation end portion 8711*e*1.

Specifically, as illustrated, a distance between an outer circumferential surface 8711*e*4 of the release prevention part 8711*e* and the central axis C of the duct coupling part 8712 remains constant, and an inner circumference surface 8711*e*3 of the release prevention part 8711*e* may comprise a portion where a distance from the central axis C of the duct coupling part 8712 remains constant, and a portion where a distance from the central axis C of the duct coupling part 8712 changes.

As illustrated, the inner circumferential surface 8711*e*3 of the release prevention part 8711*e* may comprise a non-contact surface that stays in no contact with the radial outer end portion of the stopper 8521, and a contact surface that is in contact with the radial outer end portion of the stopper 8521, for example.

The non-contact surface extends toward the free end portion 8711*e*2 from the fixation end portion 8711*e*1, has the same curvature as the outer circumferential surface 8711*e*4 and corresponds to a portion where a distance from the central axis C of the duct coupling part 8712 remains constant.

The contact surface extends to the free end portion 8711*e*2 from the position where the non-contact surface ends and corresponds to a portion where a distance from the central axis C of the duct coupling part 8712 decreases gradually.

The free end portion 8711*e*2 corresponding to the position where the contact surface ends may protrude further inward than the radial outer end portion of the stopper 8521 in the state where the release prevention part 8711*e* is not deformed as illustrated in FIG. 23.

Additionally, the contact surface corresponds to a portion that is directly pressurized by the radial outer end portion of the stopper 8521 while the lower guide 871 rotates.

Accordingly, the contact surface may be formed into a curved surface or an inclined surface such that the relative movement of the radial outer end portion of the stopper 8521 is smoothly made and frictional force decreases, for example.

Further, a tool groove 8711*e*5 may be formed on the end portion surface of the free end portion 8711*e*2 of the release prevention part 8711*e* and be concave toward the fixation end portion 8711*e*1 side with respect to the circumferential direction.

In the state where the airflow guide 87 is fixed in the fixed position completely, even if external force is applied, the airflow guide 87 is configured not to rotate in a direction where the airflow guide 87 separates from the connection duct part 85 as long as the release prevention part 8711*e* or the stopper 8521 is not broken.

Additionally, the airflow guide 87 is formed in a position farthest from the front surface of the tub 20, and the release prevention part 8711*e* is formed in a position facing the left side surface of the bottom tub 20*c*. The positions are hardly reached by the user, and the user cannot undo the holding state between the release prevention part 8711*e* and the stopper 8521 easily without an additional tool.

For the user to easily deform the release prevention part 8711*e* and undo the holding state between the free end portion 8711*e*2 of the release prevention part 8711*e* and the stopper 8521 with an ordinary tool such as a screwdriver and the like, the tool groove 8711*e*5 may be provided on the end portion surface of the free end portion 8711*e*2 of the release prevention part 8711*e*.

At this time, the tool groove 8711*e*5 may have a polygonal cross section as illustrated for an ordinary tool to be readily held at a time of undoing the holding state. FIGS. 23 and 24 show an embodiment comprising a tool groove 8711*e*5 having a cross section of a E shape, among polygons, for example.

Additionally, the release prevention part 8711*e* is configured to repeat elastically deformation at a time of assembling and separating the airflow guide 87.

Repetitive deformation may result in fatigue fracture. To prevent fatigue fracture, at least one reinforcement rib 8711*e*6 may be integrally provided on the outer circumferential surface 8711*e*4 of the release prevention part 8711*e* and protrude outward in the radial direction.

Hereafter, a relationship between the stopper 8521 of the fastening nut 852 and the operation of the release prevention part 8711*e* in the coupling process of the airflow guide 87 is described.

As described above, the lower guide 871 of the airflow guide 87 may be coupled to the duct main body 851 of the connection duct part 85 based on the two-stage coupling manipulation comprising a simple up-down perpendicular movement manipulation and a simple circumferential rotational movement manipulation.

As the up-down perpendicular movement manipulation is completed, the free end portion 8711*e*2 of the release prevention part 8711*e* may be disposed in a space between a pair of stoppers 8521 that are adjacent to each other with respect to the circumferential direction, as illustrated in FIG. 23.

As illustrated, the space between the pair of adjacent stoppers 8521 may be embodied by a circular arc groove that is open toward the outside in the upward direction and the radial direction.

As the circumferential rotational movement manipulation starts after the up-down perpendicular movement manipulation is completed, out of the pair of stoppers 8521, the radial outer end portion of a stopper 8521 disposed forward with respect to the rotation direction of the airflow guide 87, and the contact surface of the release prevention part 8711*e* may start to contact each other.

As the radial outer end portion of the stopper 8521 and the contact surface of the release prevention part 8711*e* start to contact, the rotational force of the airflow guide 87 is converted into a pressurizing force against the release prevention part 8711*e*.

Accordingly, the release prevention part 8711*e* is pressurized by the stopper 8521 that stands still, and is pushed gradually outward in the radial direction from an initial position that is no load state and starts to be elastically deformed.

At this time, the release prevention part 8711*e* may be elastically deformed continuously to the position where the free end portion 8711*e*2's contact with the radial outer end portion of the stopper 8521 is undone.

Thus, as illustrated in FIG. 24, as the contact between the free end portion 8711*e*2 of the release prevention part 8711*e* and the stopper 8521 is undone, the release prevention part 8711*e* may instantly return to the initial position with a click by using elasticity.

The free end portion 8711*e*2 of the release prevention part 8711*e* protrudes to the inside of a circular arc groove formed at the front side of the stopper 8521 at the same time as the release prevention part 8711*e* returns to the initial position.

Accordingly, once the free end portion 8711*e*2 of the release prevention part 8711*e* enters into the circular arc groove, based on the counterclockwise rotation of the airflow guide 87, as illustrated, the clockwise rotation opposite to the counterclockwise rotation must be limited by the lateral surface of the stopper 8521.

By doing so, a rotational movement in a direction where the airflow guide 87 separates from the duct main body 851 of the connection duct part may be prevented effectively through the release prevention part 8711*e* and the stopper 8521.

However, in the state where a rotational movement is not completed during the two-stage coupling manipulation, the free end portion 8711*e*2 of the release prevention part 8711*e* may rotate toward another adjacent stopper 8521 past the previous stopper 8521. At this time, the free end portion 8711*e*2 of the release prevention part 8711*e* may continue to rotate further while going over another stopper 8521, in the same way described above, and the airflow guide 87's rotation in the opposite direction may be limited in the same way.

The additional rotational movement may be performed until the guide projection provided at the duct main body 851 reaches the other end portion of the second guide groove 8712*e*, as described above.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

The invention claimed is:

1. A dishwasher, comprising:

a tub that defines a wash space configured to accommodate a wash target, the tub having a front surface that is open;

a dry air supply configured to generate dry air for drying the wash target and to supply the dry air into the wash space;

a rack configured to be inserted into and withdrawn from the wash space through the front surface of the tub, the rack being configured to support the wash target; and an airflow guide disposed between the rack and a lower surface of the tub, the airflow guide being configured to define a flow direction of the dry air and to spray the dry air into the wash space, wherein the airflow guide is disposed rearward relative to the rack, wherein the airflow guide defines a discharge opening configured to spray the dry air to the wash space, wherein a height of the discharge opening in an up-down direction is constant, and wherein the discharge opening is configured to:

spray a first portion of the dry air toward a first space between the rack and a rear surface of the tub, and spray a second portion of the dry air toward a second space defined between the lower surface of the tub and the rack.

2. The dishwasher of claim 1, wherein a first distance between the rack and the rear surface of the tub is greater than a second distance between the airflow guide and the rear surface of the tub.

3. The dishwasher of claim 2, wherein the rack is configured to, based on being inserted into the washing space, define the first space between the rack and the rear surface of the tub, a width of the first space corresponding to the first distance, and wherein the airflow guide has:

a rear end portion spaced apart from the rear surface of the tub by the second distance, the rear end portion being disposed in the first space such that the rear end portion of the airflow guide does not overlap with the rack in the up-down direction, and a front end portion that is disposed below the rack and overlaps with the rack in the up-down direction.

4. The dishwasher of claim 1, wherein a front edge of the discharge opening is disposed below the rack, and a rear edge of the discharge opening is disposed in the first space.

5. The dishwasher of claim 1, wherein a surface area of a portion of the discharge opening disposed in the first space is 25% to 50% of an entire surface area of the discharge opening.

6. The dishwasher of claim 1, wherein the height of the discharge opening in the up-down direction is less than a width of the discharge opening in a front-rear direction.

7. The dishwasher of claim 1, further comprising a spray arm rotatably disposed between the lower surface of the tub and the rack, the spray arm being configured to spray wash water for washing the wash target, and wherein the airflow guide is disposed outside a rotation range of the spray arm.

8. The dishwasher of claim 7, wherein the spray arm includes a nozzle defined at an upper surface thereof, and wherein the discharge opening is disposed at a position lower than the nozzle in the up-down direction.

9. The dishwasher of claim 8, wherein an upper end edge of the discharge opening is lower than at least a portion of the nozzle in the up-down direction.

10. The dishwasher of claim 7, wherein the discharge opening has:

a front edge that is defined at a right side surface of the airflow guide facing a right side surface of the tub; and a rear edge that is defined at a rear surface of the airflow guide facing the rear surface of the tub.

11. The dishwasher of claim 1, wherein the discharge opening is configured to spray the dry air in a direction that is offset from a center of the rack.

12. The dishwasher of claim 1, wherein the airflow guide comprises a duct coupling part connected to the dry air supply, and wherein the discharge opening is disposed rearward relative to a central axis of the duct coupling part.

13. The dishwasher of claim 1, wherein the airflow guide comprises:

a lower guide coupled to the dry air supply and configured to receive the dry air generated from the dry air supply;

an upper guide fastened to an upper side of the lower guide;

the discharge opening defined between the lower guide and the upper guide; and a misassembly prevention part configured to place the upper guide at a predetermined position relative to the lower guide.

14. The dishwasher of claim 13, wherein the lower guide comprises:

a reference surface that defines a lower end edge of the discharge opening; and a guide main body that has a plate shape, wherein the upper guide has an open lower surface that is coupled to the guide main body, wherein the misassembly prevention part comprises a misassembly prevention groove that is recessed relative to the reference surface in the up-down direction and extends along an outer edge of the guide main body, and wherein the misassembly prevention groove is configured to:

based on the upper guide being arranged in the predetermined position, receive a lower end portion of the upper guide into the misassembly prevention groove, and based on the upper guide being arranged outside the predetermined position, be disposed offset from the lower end portion of the upper guide and restrict the lower end portion of the upper guide from being inserted into the misassembly prevention groove.

15. The dishwasher of claim 14, wherein the reference surface is disposed at a first portion of the outer edge of the guide main body, and wherein the misassembly prevention groove extends along a second portion of the outer edge of the guide main body that does not include the reference surface.

16. The dishwasher of claim 15, wherein the upper guide has a notch hole that defines a front edge, a rear edge, and an upper end edge of the discharge opening, wherein the notch hole has an open lower end that extends to the lower end portion of the upper guide, and wherein the open lower end of the notch hole is configured to receive the reference surface of the lower guide based on the upper guide being coupled to the lower guide at the predetermined position.

17. The dishwasher of claim 14, wherein the lower guide further comprises a duct coupling part that is integrally formed with the guide main body, the duct coupling part having a lower end connected to the dry air supply, and wherein the misassembly prevention part further comprises:

an upper guide holding projection that protrudes from an outer side surface of the duct coupling part; and an upper guide holding hole defined at the upper guide and configured to receive the upper guide holding projection, the upper guide holding hole passing through an inside and an outside of the upper guide.

18. The dishwasher of claim 17, wherein the airflow guide further comprises a cap cover disposed at an upper side of the upper guide and coupled to the upper guide, and wherein the misassembly prevention part further comprises:

a cap cover holding projection that protrudes from an outer side surface of the upper guide; and a cap cover holding hole defined at the cap cover and configured to receive the cap cover holding projection, the cap cover holding hole passing through an inside and an outside of the cap cover.

19. A dishwasher, comprising:

a tub that defines a wash space configured to accommodate a wash target, the tub having a front surface that is open;

a dry air supply configured to generate dry air for drying the wash target and to supply the dry air into the wash space;

a rack configured to be inserted into and withdrawn from the wash space through the front surface of the tub, the rack being configured to support the wash target; and an airflow guide disposed between the rack and a lower surface of the tub, the airflow guide being configured to define a flow direction of the dry air and to spray the dry air into the wash space, wherein the airflow guide is disposed rearward relative to the rack, wherein the airflow guide comprises:

a lower guide coupled to the dry air supply and configured to receive the dry air generated from the dry air supply, an upper guide fastened to an upper side of the lower guide, a discharge opening defined between the lower guide and the upper guide and configured to spray the dry air to the wash space, and a misassembly prevention part configured to place the upper guide at a predetermined position relative to the lower guide, wherein the lower guide comprises:

a reference surface that defines a lower end edge of the discharge opening, and a guide main body that has a plate shape, wherein the upper guide has an open lower surface that is coupled to the guide main body, wherein the misassembly prevention part comprises a misassembly prevention groove that is recessed relative to the reference surface in an up-down direction and extends along an outer edge of the guide main body, and wherein the misassembly prevention groove is configured to:

based on the upper guide being arranged in the predetermined position, receive a lower end portion of the upper guide into the misassembly prevention groove, and based on the upper guide being arranged outside the predetermined position, be disposed offset from the lower end portion of the upper guide and restrict the lower end portion of the upper guide from being inserted into the misassembly prevention groove.

* * * * *